US008640475B2

(12) United States Patent
Park et al.

(10) Patent No.: US 8,640,475 B2
(45) Date of Patent: Feb. 4, 2014

(54) HEAT PUMP-TYPE HOT WATER FEEDING APPARATUS

(75) Inventors: Heewoong Park, Changwon-si (KR); Samchul Ha, Changwon-si (KR); Simwon Chin, Changwon-si (KR); Seunghyun Jung, Changwon-si (KR); Noma Park, Changwon-si (KR); Hwanjong Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 316 days.

(21) Appl. No.: 13/186,873

(22) Filed: Jul. 20, 2011

(65) Prior Publication Data

US 2012/0042678 A1 Feb. 23, 2012

(30) Foreign Application Priority Data

Jul. 23, 2010 (KR) ..... 10-2010-0071550

(51) Int. Cl.
*F25B 27/00* (2006.01)

(52) U.S. Cl.
USPC ..... 62/238.7; 62/324.1

(58) Field of Classification Search
USPC ..... 62/238.7, 324.1, 160, 238.6, 175, 183, 62/325, 201, 278, 434, 335; 165/10, 61; 237/2 B, 1 A
See application file for complete search history.

(56) References Cited

U.S. PATENT DOCUMENTS

| | | | | | |
|---|---|---|---|---|---|
| 4,237,859 | A | * | 12/1980 | Goettl | 126/400 |
| 4,378,908 | A | * | 4/1983 | Wood | 237/2 B |
| 4,414,818 | A | * | 11/1983 | Turbard et al. | 62/176.1 |
| 4,474,018 | A | * | 10/1984 | Teagan | 62/79 |
| 4,522,253 | A | * | 6/1985 | Levin | 165/207 |
| 4,796,437 | A | * | 1/1989 | James | 62/79 |
| 5,177,977 | A | * | 1/1993 | Larsen | 62/235.1 |
| 5,247,811 | A | * | 9/1993 | Seya et al. | 62/434 |
| 5,388,420 | A | * | 2/1995 | Yoshida et al. | 62/160 |
| 5,435,380 | A | * | 7/1995 | Yamada et al. | 165/104.28 |

FOREIGN PATENT DOCUMENTS

| | | |
|---|---|---|
| CN | 101226019 A | 7/2008 |
| JP | 2005-249319 | 9/2005 |

OTHER PUBLICATIONS

Chinese Office Action issued in Application No. 201110213974.4 dated Oct. 21, 2013.

* cited by examiner

*Primary Examiner* — Mohammad M Ali
(74) *Attorney, Agent, or Firm* — KED & Associates, LLP

(57) ABSTRACT

A heat pump-type hot water feeding apparatus includes a cooling cycle circuit, a heat storage tank, and a hydro kit heat exchanging unit, wherein the hydro kit heat exchanging unit is connected to the cooling cycle circuit, wherein during a heat storage mode operation that stores heat in the heat storage tank, heat of the first heat transfer fluid, which is heat exchanged in the first heat exchanger, is stored in the heat storage tank or heat of the first heat transfer fluid, which is heat exchanged in the first heat exchanger and heat of the second heat transfer fluid, which is heat exchanged in the second heat exchanger, are simultaneously stored in the heat storage tank.

16 Claims, 11 Drawing Sheets

HEAT PUMP-TYPE HOT WATER FEEDING APPARATUS

CROSS-REFERENCE TO RELATED APPLICATION

This application claims priority to Korean Patent Application No. 10-2010-0071550 filed on Jul. 23, 2010, the contents of which are herein incorporated by reference in its entirety.

BACKGROUND OF THE INVENTION

1. Technical Field

The embodiments of the present invention are directed to a heat pump-type hot water feeding apparatus, and particularly to a heat pump-type hot water feeding apparatus that may selectively activate an indoor floor heating mode operation or a hot water feeding mode operation through a heat storage tank and allows coolant compressed by a compressor to be selectively used for at least one of hot water feeding or air conditioning.

2. Discussion of the Related Art

In general, heat pumps are room cooling/heating apparatuses that transfer heat from a low temperature source to a high temperature source and vice versa by using heat generation or condensation heat of coolant.

A heat pump includes a compressor, a condenser, an expander, and an evaporator. Heat pump-type hot water feeding apparatuses are being developed that may heat water as coolant and may use the heated water for hot water feeding so as to minimize consumption of fossil fuels.

In the conventional heat pump-type hot water feeding apparatus, coolant passing through a hot water feeding heat exchanger passes through all of an outdoor heat exchanger, an expander, and an indoor heat exchanger for condensation, expansion, and evaporation, thus resulting in deterioration of hot water feeding efficiency.

SUMMARY OF THE INVENTION

Exemplary embodiments of the present invention provide a heat pump-type hot water feeding apparatus that is configured so that coolant passing through a hot water feeding heat exchanger bypasses one of an outdoor heat exchanger and an indoor heat exchanger to increase efficiency of hot water feeding and that may selectively operate through a heat storage tank in an indoor floor heating mode or hot water feeding mode.

According to an embodiment of the present invention, there is provided a heat pump-type hot water feeding apparatus comprising a cooling cycle circuit configured so that coolant flows through a compressor, an indoor heat exchanger, an expander, and an outdoor heat exchanger, a heat storage tank that stores heat exchanged with coolant branched from the cooling cycle circuit, and a hydro kit heat exchanging unit that includes a first heat exchanger that performs heat exchange between a first heat transfer fluid and coolant compressed in a supersaturated region by the compressor and primarily condenses the coolant and a second heat exchanger that performs heat exchange between the primarily condensed coolant and a second heat transfer fluid and secondarily condenses the coolant, wherein the hydro kit heat exchanging unit is connected to the cooling cycle circuit, wherein during a heat storage mode operation that stores heat in the heat storage tank, heat of the first heat transfer fluid, which is heat exchanged in the first heat exchanger, is stored in the heat storage tank or heat of the first heat transfer fluid, which is heat exchanged in the first heat exchanger and heat of the second heat transfer fluid, which is heat exchanged in the second heat exchanger, are simultaneously stored in the heat storage tank.

The heat of the second heat transfer fluid is not only stored in the heat storage tank but also used for floor heating water of a floor heating unit according to a user's selection.

The first and second heat transfer fluids respectively flow through a first heat storage path and a second heat storage path that pass through the heat storage tank to store heat in heat storage water contained in the heat storage tank.

During the heat storage mode operation, the heat of the first heat transfer fluid alone is stored in the heat storage water, the heat of the second heat transfer fluid alone is stored in the heat storage water, or the heat of the first and second heat transfer fluids are simultaneously stored in the heat storage water.

The first heat exchanger is a heat exchanger only for heat storage, which stores in the heat storage tank heat exchanged during a mode operation including the heat storage mode operation.

The second heat exchanger performs heat exchanger between the floor heating water and the coolant for floor heating during a floor heating mode operation and stores in the heat storage tank heat of the floor heating water, which is exchanged during a mode operation including the heat storage mode operation.

The mode operation includes a room cooling mode operation for room cooling, a room heating mode operation for room heating, and a hot water feeding mode operation for providing the heat storage water contained in the heat storage tank, wherein the heat storage mode operation alone is performed, or the heat storage mode operation and the mode operation are simultaneously performed.

The heat pump-type hot water feeding apparatus further comprises a coolant adjuster that is provided in the cooling cycle circuit and enables the coolant to selectively flow to the hydro kit heat exchanging unit.

The coolant adjuster enables the coolant to selectively flow to at least one of the cooling cycle circuit or the hydro kit heat exchanging unit.

The coolant adjuster adjusts the coolant to flow to the hydro kit heat exchanger when at least one of the hot water feeding mode operation, the floor heating mode operation, and the heat storage mode operation is performed.

The coolant adjuster adjusts the coolant to bypass the hydro kit heat exchanging unit when at least one of the room heating mode operation and the room cooling mode operation is only performed.

The heat pump-type hot water feeding apparatus further comprises a heat exchanger bypass path that guides coolant passing through the first and second heat exchangers to between the outdoor heat exchanger and the indoor heat exchanger so that the coolant bypasses one of the outdoor heat exchanger and the indoor heat exchanger.

Coolant selectively flows through the heat exchanger bypass path by an auxiliary coolant adjuster that is provided between the heat exchanger bypass path and the hydro kit heat exchanging unit.

The auxiliary coolant adjuster adjusts the coolant to flow through the heat exchanger bypass path when only any one of the heat storage mode operation, the hot water feeding mode operation, and the floor heating mode operation is performed.

The auxiliary coolant adjuster adjusts the coolant to bypass the heat exchanger bypass path when any one of the heat storage mode operation, the hot water feeding mode operation, and the floor heating mode operation is performed together with one of the room cooling mode operation and the room heating mode operation.

The heat pump-type hot water feeding apparatus further comprises a sub heater that electrically heats the heat storage water in the heat storage tank, wherein the sub heater is activated only in a heat storage mode that stores heat in the heat storage water of the heat storage tank.

According to the embodiments, the heat pump-type hot water feeding apparatus may store in the heat storage tank the condensation heat of the coolant flowing through the hydro kit heat exchanging unit during the hot water feeding mode operation or indoor floor heating mode operation.

The hydro kit heat exchanging unit is separately provided from the outdoor unit, thus saving installation space.

The heat is stored in the heat storage tank during a time period that exhibits a less power rate, thus relieving consumers of burden in light of power consumption.

BRIEF DESCRIPTION OF THE DRAWINGS

The embodiments of the present invention will become readily apparent by reference to the following detailed description when considered in conjunction with the accompanying drawings wherein.

DETAILED DESCRIPTION

Hereinafter, embodiments of the present invention will be described with respect to the accompanying drawings.

Figure 1:
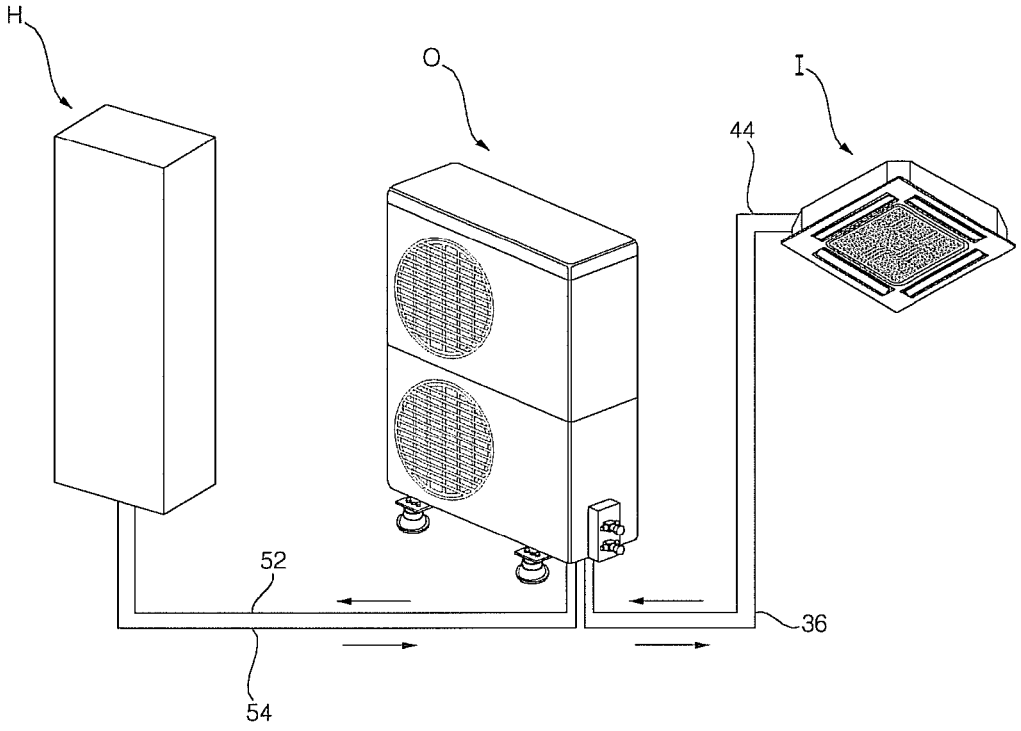
FIG. 1 is a view schematically illustrating a heat pump-type hot water feeding apparatus according to an embodiment of the present invention.
Figure 2:
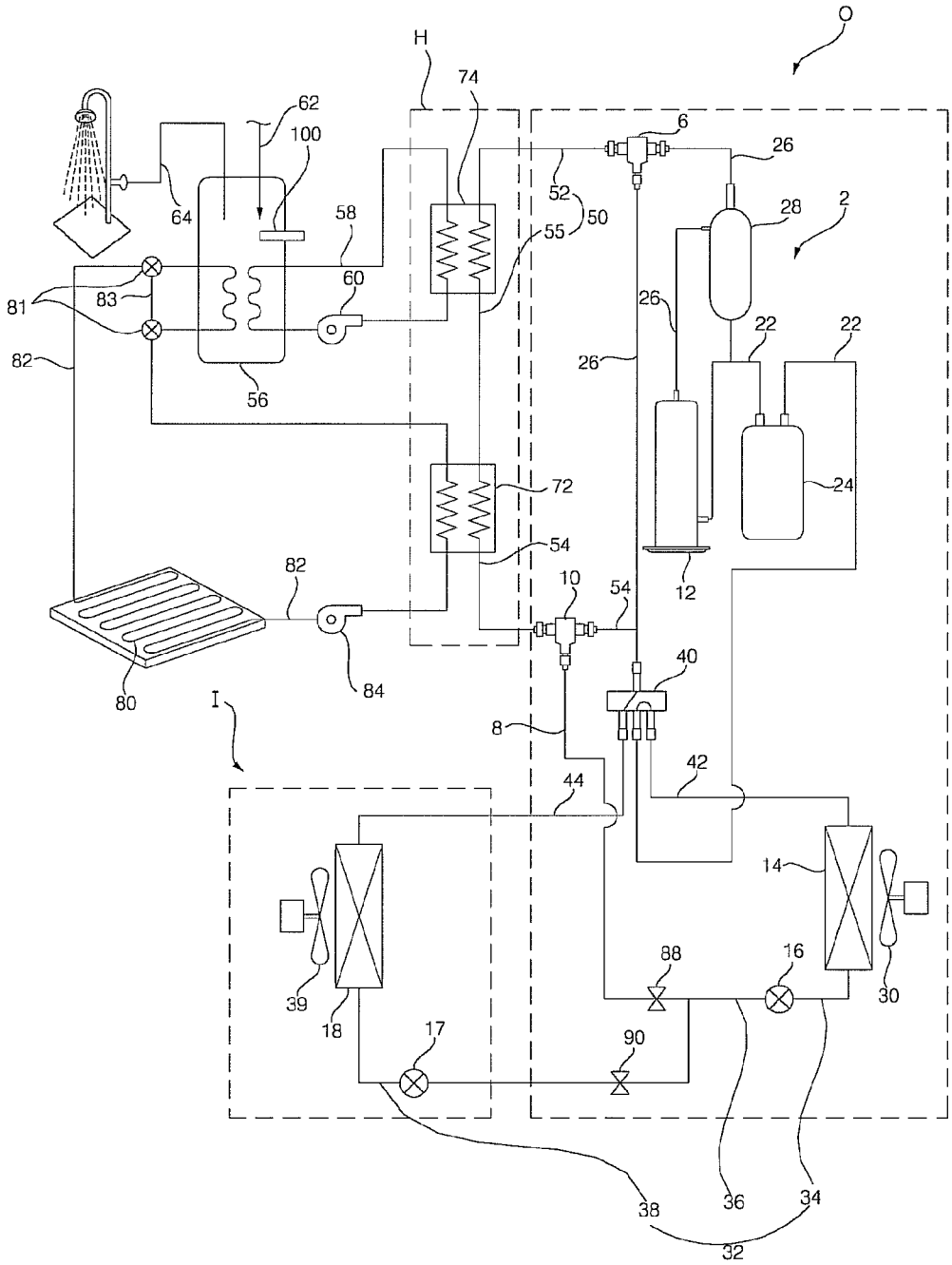
FIG. 2 is a pneumatic circuit diagram illustrating a heat pump-type hot water feeding apparatus according to an embodiment of the present invention.

FIG. 1 is a view schematically illustrating a heat pump-type hot water feeding apparatus according to an embodiment of the present invention. FIG. 2 is a pneumatic circuit diagram illustrating a heat pump-type hot water feeding apparatus according to an embodiment of the present invention.

A heat pump-type hot water feeding apparatus according to an embodiment includes a cooling cycle circuit 2, a hot water heat exchanger 4, a coolant adjuster 6, a heat exchanger bypass path 8, and an auxiliary coolant adjuster 10.

The cooling cycle circuit 2 includes a compressor 12, an outdoor heat exchanger 14, expanders 16 and 17, and an indoor heat exchanger 18. The cooling cycle circuit 2 performs air conditioning on a room, such as heating or cooling the room.

The air conditioning operation of the cooling cycle circuit 2 includes a room heating mode operation that sucks and heats air from the room and a room cooling mode operation that sucks and cools air from the room.

The cooling cycle circuit 2 further includes an accumulator 24 that is provided in a suction path 22 to prevent a liquid coolant from flowing into the compressor 12 and an oil separator 28 that is provided in a discharge path 26 to separate oil from a coolant discharged including the oil to recover the separated oil to the compressor 12.

The outdoor heat exchanger 14 condenses or evaporates a coolant. The outdoor heat exchanger 14 may include an air coolant heat exchanger that performs heat exchange between outdoor air and a coolant and a water coolant heat exchanger that performs heat exchange between cooling water and a coolant.

In the event that the outdoor heat exchanger 14 is implemented as an air coolant heat exchanger, an outdoor fan 30 is provided at a proper location to blow outdoor air to the outdoor heat exchanger 14.

The outdoor heat exchanger 14 is connected to the indoor heat exchanger 18 via heat exchanger connecting pipes 32.

The expanders 16 and 17 are connected to the heat exchanger connecting pipes 32.

The expanders 16 and 17 include an outdoor expander 16 that is located adjacent to the outdoor heat exchanger 14 and an indoor expander 17 that is located adjacent to the indoor heat exchanger 18.

The heat exchanger connecting pipes 32 include an outdoor heat exchanger-outdoor expander connecting pipe 34 that connects the outdoor heat exchanger 14 to the outdoor expander 16, an expander connecting pipe 36 that connects the outdoor expander 16 to the indoor expander 17, and an indoor expander-indoor heat exchanger connecting pipe 38 that connects the indoor expander 17 to the 18.

The indoor heat exchanger 18 performs heat exchange between indoor air and a coolant for room cooling or heating. An indoor fan 39 is provided at a proper location to circulate indoor air to the indoor heat exchanger 18.

The cooling cycle circuit 2 allows coolant compressed and discharged by the compressor 12 to sequentially pass through the outdoor heat exchanger 14, the expanders 16 and 17, and the indoor heat exchanger 18 to the compressor 12 so that the indoor heat exchanger 18 may evaporate the coolant to cool the indoor air. For example, the cooling cycle circuit 2 may be configured as a room cooling air conditioner.

The cooling cycle circuit 2 also allows coolant compressed and discharged by the compressor 12 to sequentially pass through the indoor heat exchanger 18, the expanders 16 and 17, and the outdoor heat exchanger 14 to the compressor 12 so that the outdoor heat exchanger 14 may condense the coolant to heat the indoor air. For example, the cooling cycle circuit 2 may be configured as a room heating air conditioner.

Further, the cooling cycle circuit 2 may be configured as a room cooling/heating air conditioner that, during a room heating operation, allows coolant compressed by the compressor 12 to sequentially pass through the outdoor heat exchanger 14, the expanders 16 and 17, and the indoor heat exchanger 18 to the compressor 12 and, during a room cooling operation, allows coolant compressed by the compressor 12 to sequentially pass through the indoor heat exchanger 18, the expanders 16 and 17, and the outdoor heat exchanger 14 to the compressor 12.

For example, the cooling cycle circuit 2 may be configured so that the indoor heat exchanger 18 cools or heats the room. Hereinafter, an embodiment will be described where the cooling cycle circuit 2 is configured as a room cooling/heating air conditioner that may switch between the cooling and heating operations.

The cooling cycle circuit 2 further includes a room cooling/heating switching valve 40 that allows coolant to sequentially flow through the compressor 12, the outdoor heat exchanger 14, the expanders 16 and 17, and the indoor heat exchanger 18 or to sequentially flow through the compressor 12, the indoor heat exchanger 18, the expanders 16 and 17, and the outdoor heat exchanger 14.

The room cooling/heating switching valve 40 is connected to the compressor 12 via the suction path 22 and the discharge path 26, connected to the outdoor heat exchanger 14 via an outdoor heat exchanger connection pipe 42, and connected to the indoor heat exchanger 18 via an indoor heat exchanger connection pipe 44.

The cooling cycle circuit 2 may be also configured so that coolant may flow into the room cooling/heating switching valve 40 or the outdoor heat exchanger 14 through the auxiliary coolant adjuster 10 after having flowed through a hydro kit H having the first heat exchanger 74, which is a hot water heat exchanger, and the second heat exchanger 72, which is a cool water coolant heat exchanger, without directly flowing to the room cooling/heating switching valve 40 by the coolant adjuster 6.

The first heat exchanger 74 functions as a hot water heat exchanger that generates hot water. The second heat exchanger 72 functions as a cool water coolant heat exchanger that heats water for room heating.

The first heat exchanger 74 is connected to the cooling cycle circuit 2 via a hydro kit heat exchanger path 50 so that coolant discharged from the compressor 12 is used for hot water feeding and then condensed, expanded, and evaporated by the cooling cycle circuit 2.

The hydro kit heat exchanger path 50 includes a hydro kit heat exchanger inlet path 52 through which coolant of the cooling cycle circuit 2, for example, coolant compressed and discharged by the compressor 12 flows to the first heat exchanger 74, and a hydro kit heat exchanger outlet path 54 through which coolant discharged from the first heat exchanger 74 flows to the room cooling/heating switching valve 40 via the cooling cycle circuit 2, for example, the second heat exchanger 72.

A hot water feeding outlet path 55, which connects the first heat exchanger 74 to the second heat exchanger 72, functions as an outlet path through which coolant heat exchanged in the first heat exchanger 74 is exited and as an inlet path through which coolant is entered to the second heat exchanger 72 for heat exchange.

The hydro kit heat exchanger inlet path 52 and the hydro kit heat exchanger outlet path 54 of the hydro kit heat exchanger H are connected between the compressor 12 and the room cooling/heating switching valve 40.

An end of the hydro kit heat exchanger inlet path 52 is connected to the discharge path 26, and the other end of the hydro kit heat exchanger inlet path 52 is connected to the first heat exchanger 74.

An end of the hydro kit heat exchanger outlet path 54 is connected to the first heat exchanger 74, and the other end of the hydro kit heat exchanger outlet path 54 is connected to the second heat exchanger 72.

The first heat exchanger 74 is a type of de-super heater that allows coolant overheated by the compressor 12 to be subjected to heat exchange with a first heat fluid used for hot water feeding to be condensed when coolant flows into the first heat exchanger 74 by the coolant adjuster 6. The first heat fluid may be water.

The first heat exchanger 74 may include a coolant path through which the overheated coolant passes and a first heat fluid path through which the first heat fluid passes to be used for hot water feeding.

The first heat exchanger 74 may be implemented as a dual pipe heat exchanger that includes a coolant path and a heat storage water pipe 58 (which constitutes the first heat fluid path) that are respectively formed at an inner portion and an outer portion of a heat transfer member located between the coolant path and the heat storage water pipe 58. The first heat exchanger 74 may be also implemented as a plate-type heat exchanger that includes a coolant path and a heat storage water pipe 58 that are alternately arranged with respect to a heat transfer member.

The first heat exchanger 74 is connected via the heat storage water pipe 58 to a heat storage tank 56 containing heat storage water (which is also referred to as "hot water") for hot water feeding. A hot water pump 60 is provided in the heat storage water pipe 58 to generate a force for making a heat transfer fluid flow in the heat storage water pipe 58. For ease of convenience, a water path is hereinafter referred to as a "first heat storage path", where water is introduced into the heat storage tank 56 through the heat storage water pipe 58 and then discharged from the heat storage tank 56 via the hot water pump 60 to the first heat exchanger 74.

A water supplier 62 for supplying water from an external source to the heat storage tank 56 and a water discharging unit 64 for discharging hot water from the heat storage tank 56 to an external destination are connected to the heat storage tank 56.

The heat storage tank 56 may be configured so that the first heat fluid heated by the first heat exchanger 74 and entered into the heat storage tank 56 is directly discharged to the water discharging unit 64.

A hot water coil is installed in the heat storage tank 56 to be connected to the heat storage water pipe 58 so that the first heat fluid heated by the first heat exchanger 74 heats the inside of the heat storage tank 56 while passing through the hot water coil and heat storage water entered into the water supplier 62 is heated by the hot water coil and then discharged to the water discharging unit 64.

In the heat pump-type hot water feeding apparatus, coolant immediately flows into the room cooling/heating switching valve 40 by the coolant adjuster 6 to be used for heating the room or sequentially passes through the first heat exchanger 74 and the second heat exchanger 72 to be used for heating the indoor floor or for feeding hot water, then goes back to the cooling cycle circuit 2.

The heat pump-type hot water feeding apparatus may further include a second heat exchanger 72 that functions as a water coolant heat exchanger connected to the hydro kit heat exchanger path 50 via the hot water feeding outlet path 55 so that coolant passes through the first heat exchanger 74 to heat the first heat fluid and then flows to the hydro kit heat exchanger path 50.

The hot water feeding outlet path 55 is configured so that coolant of the first heat exchanger 74 may be immediately entered into the second heat exchanger 72. The second heat exchanger 72 is connected to the auxiliary coolant adjuster 10 via the hydro kit heat exchanger outlet path 54.

The second heat exchanger 72 is a condensing heat exchanger where coolant primarily condensed by the first heat exchanger 74 is further condensed while exchanging heat with the second heat fluid. Like the second heat fluid, the second heat fluid may be water.

The second heat exchanger 72 may include a coolant path through which coolant having passed through the first heat exchanger 74 passes and a path through which the second heat fluid used for floor heating or room heating passes.

The second heat exchanger 72 may be implemented as a dual pipe heat exchanger that includes a coolant path and a path through which the second heat fluid passes that are respectively formed at an inner portion and an outer portion of a heat transfer member located between the coolant path and the path for passage of the second heat fluid. The second heat exchanger 72 may be also implemented as a plate-type heat exchanger that includes a coolant path and a path for passage of the second heat fluid that are alternately arranged with respect to a heat transfer member. The second fluid may be water and may be also referred to as "floor heating water".

In the heat pump-type hot water feeding apparatus, the second heat exchanger 72 is connected to a floor heating pipe 80 via a room heating water pipe 82, and a floor heating pump 84 is installed in the room heating water pipe 82. Thus, heat from coolant passing through the first heat exchanger 74 may be additionally used for floor heating in the room. For convenience of description, a path of the second heat fluid that passes through the room heating water pipe 82, the heat storage tank 56, the floor heating pipe 80, and the floor heating pump 84 to the second heat exchanger 72 is hereinafter referred to as a "second heat storage path".

In the heat pump-type hot water feeding apparatus, the second heat exchanger 72 is installed in a casing. When an indoor fan is installed in the casing to circulate indoor air to the second heat exchanger 72, the casing of the second heat exchanger 72 and the indoor fan constitute a fan coil unit that circulates indoor air for room heating. Heat from coolant passing through the first heat exchanger 74 may be additionally used for indoor room heating.

For ease of description, an embodiment is described where the floor heating pipe 80 is connected to the second heat exchanger 72 through the room heating water pipe 82, and the floor heating pump 84 is installed in the room heating water pipe 82.

The heat pump-type hot water feeding apparatus may be configured so that immediately after passing through the first heat exchanger 74, coolant may pass through the second heat exchanger 72. The heat pump-type hot water feeding apparatus may further include a water coolant heat exchanger coolant adjuster (not shown) that adjusts flow of coolant passing through the first heat exchanger 74 so that the coolant bypasses without passing through the second heat exchanger 72.

The second heat exchanger 72 may be directly connected to the hot water feeding outlet path 55 so that coolant passing through the first heat exchanger 74 may be always used for floor heating or so that a user may selectively perform a floor heating operation.

The water coolant heat exchanger coolant adjuster (not shown) is a floor heating valve that allows coolant to pass through the second heat exchanger 72 when a user opts for floor heating.

In the case that the operation of the heat pump-type hot water feeding apparatus includes a floor heating operation, the water coolant heat exchanger coolant adjuster adjusts the flow direction of coolant so that the coolant flows to the first heat exchanger 74. In the case that the operation of the heat pump-type hot water feeding apparatus does not include the floor heating operation, the water coolant heat exchanger coolant adjuster adjusts the flow direction of coolant so that the coolant bypasses the first heat exchanger 74.

However, the water coolant heat exchanger is not an inevitable component. According to an embodiment, in the event that the operation of the heat pump-type hot water feeding apparatus does not include the floor heating operation, the floor heating pump 84 may be inactivated or a bypass path 83 may be provided in the room heating water pipe 82 not to pass through the heat storage tank 56 with bypass adjusting valves 81 provided between two ends of the bypass path 83 so that the flow direction of coolant may be adjusted not to be involved in the floor heating operation.

The coolant adjuster 6 adjusts flow direction of coolant discharged from the compressor 12 so that the coolant passes through or bypass the first heat exchanger 74.

In the case that the operation of the heat pump-type hot water feeding apparatus includes at least one of a hot water feeding mode operation and a floor heating operation, the coolant adjuster 6 adjusts coolant compressed by the compressor 12 to flow into the first heat exchanger 74. In the case that the operation of the heat pump-type hot water feeding apparatus includes neither the hot water feeding mode operation nor the floor heating operation, the coolant adjuster 6 adjusts the coolant compressed by the compressor 12 to bypass the first heat exchanger 74 and the second heat exchanger 72.

While performing the hot water feeding mode operation, the coolant adjuster 6 adjusts coolant to flow into the first heat exchanger 74 and the second heat exchanger 72.

While simultaneously performing both the hot water feeding mode operation and air conditioning mode operation, the coolant adjuster 6 adjusts coolant to flow into the first heat exchanger 74 and the second heat exchanger 72.

While simultaneously performing both the hot water feeding mode operation and floor heating mode operation, the coolant adjuster 6 adjusts coolant to flow into the first heat exchanger 74 and the second heat exchanger 72.

While simultaneously performing all of the hot water feeding mode operation, floor heating mode operation, and air conditioning mode operation, the coolant adjuster 6 adjusts coolant to flow into the first heat exchanger 74 and the second heat exchanger 72.

While performing the floor heating mode operation, the coolant adjuster 6 adjusts coolant to flow into the first heat exchanger 74 and the second heat exchanger 72.

During the air conditioning mode operation, the coolant adjuster 6 adjusts coolant to bypass the first heat exchanger 74. For example, during a room cooling mode operation, the coolant adjuster 6 adjusts the coolant to bypass the first heat exchanger 74 and the second heat exchanger 72, and during a room heating mode operation, the coolant adjuster 6 adjusts the coolant to bypass the first heat exchanger 74 and the second heat exchanger 72.

The coolant adjuster 6 may be configured as a three-way valve that is provided in the cooling cycle circuit 2 to select a coolant discharging direction.

In the case that the coolant adjuster 6 is a three-way valve, the coolant adjuster 6 includes an inlet, a first outlet, and a second outlet, wherein the inlet and the first outlet are connected to the discharge path 26, and the second outlet is connected to the hydro kit heat exchanger inlet path 52.

The coolant adjuster 6 includes a first valve between the coolant adjuster 6 and the room cooling/heating switching valve 40 over the discharge path 26 and a second valve over the hydro kit heat exchanger inlet path 52. The first valve of the coolant adjuster 6 is closed when at least one of the hot water feeding mode and the floor heating mode operates and opened when the air conditioning mode operates. The second valve of the coolant adjuster 6 is opened when at least one of the hot water feeding mode and the floor heating mode operates and closed when the air conditioning mode operates.

The heat exchanger bypass path 8 guides coolant passing through the first heat exchanger 74 and the second heat exchanger 72 to between the outdoor heat exchanger 14 and the indoor heat exchanger 18 so that the coolant bypasses one of the outdoor heat exchanger 14 and the indoor heat exchanger 18.

One end of the heat exchanger bypass path 8 is connected to the hydro kit heat exchanger path 50, and the other end of the heat exchanger bypass path 8 is connected between the indoor expander 17 and the outdoor expander 16.

One of the heat exchanger bypass path 8 is connected to the hydro kit heat exchanger outlet path 54 of the hydro kit heat exchanger path 50, and the other end of the heat exchanger bypass path 8 is connected to the expander connecting pipe 36 so that the heat exchanger bypass path 8 may guide coolant from the hydro kit heat exchanger outlet path 54 to between the indoor expander 17 and the outdoor expander 16.

The coolant guided along the heat exchanger bypass path 8 is expanded by the indoor expander 17, evaporated by the indoor heat exchanger 18, and then recovered into the compressor 12, or expanded by the outdoor expander 16, evaporated by the outdoor heat exchanger 14, and then recovered into the compressor 12.

For example, in the case that coolant is guided through the heat exchanger bypass path 8 to between the indoor expander 17 and the outdoor expander 16, only expansion and evaporation procedures occur at the cooling cycle circuit 2 without condensation while heat transfer increase at the first heat exchanger 74 and the second heat exchanger 72, thus increasing efficiency of hot water feeding and floor heating.

The auxiliary coolant adjuster 10 adjusts flow direction of coolant passing through the first heat exchanger 74 and the second heat exchanger 72 so that the coolant passes through or bypasses the heat exchanger bypass path 8.

Specifically, the auxiliary coolant adjuster 10 adjusts coolant passing through the first heat exchanger 74 and the second heat exchanger 72 so that the coolant bypasses the heat exchanger bypass path 8 in the case that the operation of the heat pump-type hot water feeding apparatus includes both hot water feeding mode operation and air conditioning mode operation.

The auxiliary coolant adjuster 10 adjusts coolant passing through the first heat exchanger 74 and the second heat exchanger 72 so that the coolant bypasses the heat exchanger bypass path 8 in the case that both hot water feeding mode operation and air conditioning mode operation are simultaneously performed.

The auxiliary coolant adjuster 10 adjusts coolant passing through the first heat exchanger 74 and the second heat exchanger 72 so that the coolant bypasses the heat exchanger bypass path 8 in the case that both hot water feeding mode operation and floor heating mode operation are simultaneously performed.

The auxiliary coolant adjuster 10 adjusts coolant passing through the first heat exchanger 74 and the second heat exchanger 72 so that the coolant flows into the heat exchanger bypass path 8 in the case that the air conditioning mode operation is performed.

The auxiliary coolant adjuster 10 adjusts coolant passing through the first heat exchanger 74 and the second heat exchanger 72 so that the coolant flows into the heat exchanger bypass path 8 in the case that the hot water feeding mode operation is performed.

The auxiliary coolant adjuster 10 adjusts coolant passing through the first heat exchanger 74 and the second heat exchanger 72 so that the coolant flows into the heat exchanger bypass path 8 in the case that both the hot water feeding mode operation and floor heating mode operation are performed.

The auxiliary coolant adjuster 10 adjusts coolant passing through the first heat exchanger 74 and the second heat exchanger 72 so that the coolant flows into the heat exchanger bypass path 8 in the case that the floor heating mode operation is performed.

When a defrost condition is satisfied during the hot water feeding mode operation, the auxiliary coolant adjuster 10 adjusts coolant passing through the first heat exchanger 74 and the second heat exchanger 72 to bypass the heat exchanger bypass path 8, and the cooling cycle circuit 2 switches from the room heating operation to the room cooling operation to defrost the outdoor heat exchanger 14. The defrost process of the outdoor heat exchanger 14 will be described below in further detail.

According to an embodiment, the auxiliary coolant adjuster 10 may be configured as a three-way valve that is provided over the hydro kit heat exchanger outlet path 54 to select a coolant discharge direction.

In the event that the auxiliary coolant adjuster 10 is a three-way valve, an inlet and a first outlet are connected to the hydro kit heat exchanger outlet path 54, and a second outlet is connected to the heat exchanger bypass path 8.

According to an embodiment, the auxiliary coolant adjuster 10 may include a first valve between the hydro kit heat exchanger outlet path 54 and the room cooling/heating switching valve 40 and a second valve over the heat exchanger bypass path 8. The first valve of the auxiliary coolant adjuster 10 is opened when the hot water feeding mode operation and air conditioning mode operation are performed or the floor heating mode operation and hot water feeding mode operation are performed, and closed when at least one of the floor heating mode operation and the hot water feeding mode operation is performed while the air conditioning mode operation is not performed. The second valve of the auxiliary coolant adjuster 10 is closed when the hot water feeding mode operation and the air conditioning mode operation are performed or the floor heating mode operation and the air conditioning mode operation are performed and opened when at least one of the floor heating mode operation and the hot water feeding mode operation is performed while the air conditioning mode operation is not performed.

The heat pump-type hot water feeding apparatus further includes a heat exchanger bypass valve 88 that is provided over the heat exchanger bypass path 8 to switch the flow of coolant and a liquid coolant valve 90 that is provided between the heat exchanger bypass path 8 and the indoor expander 17 to switch the flow of coolant.

The heat exchanger bypass valve 88 is opened when both or either of the hot water feeding mode operation and/or the floor heating mode operation are performed and closed when the air conditioning mode operation is performed when both the air conditioning mode operation and the hot water feeding mode operation are performed, or when the air conditioning mode operation, the hot water feeding mode operation, and the floor heating mode operation are all performed.

The liquid coolant valve 90 is opened when the air conditioning mode operation is performed, when both the air conditioning mode operation and the hot water feeding mode operation are performed, or when the air conditioning mode operation, the hot water feeding mode operation, and the floor heating mode operation are all performed, and closed when both or either of the hot water feeding mode operation and/or the floor heating mode operation are performed.

The heat pump-type hot water feeding apparatus may be configured as a separation-type air conditioner in which the cooling cycle circuit 2 includes an outdoor unit O and an indoor unit I, and the hydro kit heat exchanger H may be connected to the outdoor unit O.

The compressor 12, the room cooling/heating switching valve 40, the outdoor heat exchanger 14, the outdoor expander 16, and the outdoor fan 30 are installed in the outdoor unit O.

The indoor expander 17, the indoor heat exchanger 18, and the indoor fan 39 are installed in the indoor unit I.

Any one of the first heat exchanger 74, the hot water pump 60, the second heat exchanger 72, the floor heating pump 84, the water coolant heat exchanger coolant adjuster, or the bypass path 83 is installed in the hydro kit heat exchanger H.

Unlike the conventional configuration that uses coolant only from the first heat exchanger 74 for heat storage by the heat storage tank 56, the hydro kit heat exchanger H may use coolant from the second heat exchanger 72 as well as coolant from the first heat exchanger 74 and after heat storage may selectively perform the hot water feeding mode operation or floor heating mode operation, thus relieving consumers of burden.

Further, the hydro kit heat exchanger H configured to provide a function of the conventional hot water feeding tank in a single heat storage tank may perform all of the heat storage mode and hot water feeding mode operation and the floor heating mode operation, thus saving space for installation.

According to an embodiment, the coolant adjuster 6, the heat exchanger bypass path 8, the auxiliary coolant adjuster 10, the heat exchanger bypass valve 88, and the liquid coolant valve 90 may be installed in the outdoor unit O.

The heat storage tank 56 may further include a sub heater 100 for electrically heating heat storage water. The auxiliary coolant adjuster 100 is activated when the heat pump-type hot water feeding apparatus operates only in the heat storage mode, quickly heating the heat storage water in the heat storage tank 56.

Figure 3:
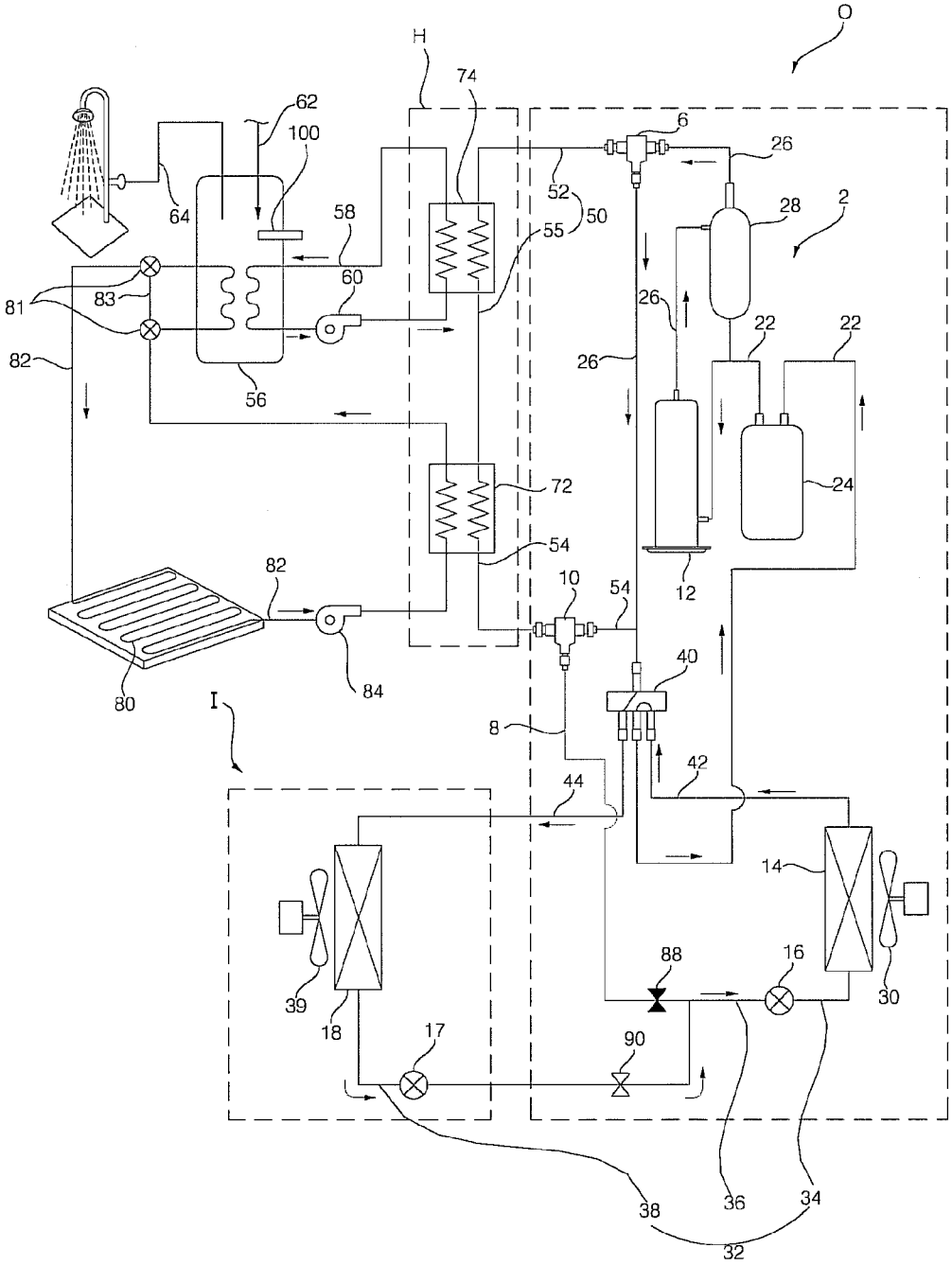
FIG. 3 illustrates a flow of coolant when the heat pump-type hot water feeding apparatus shown in FIG. 2 operates in a room cooling mode.

FIG. 3 illustrates a flow of coolant when the heat pump-type hot water feeding apparatus shown in FIG. 2 operates in a room cooling mode.

Under the room cooling mode operation, the heat pump-type hot water feeding apparatus operates as follows: The compressor 12 is activated, the coolant adjuster 6 adjusts coolant to bypass the first heat exchanger 74, the second heat exchanger 72, and the auxiliary coolant adjuster 10 to the room cooling/heating switching valve 40, the outdoor fan 30 and the indoor fan 39 are rotated, the room cooling/heating switching valve 40 is activated in a room cooling mode, the heat exchanger bypass valve 88 is closed, the liquid coolant valve 90 is opened, and the hot water pump 60 and the floor heating pump 84 remain inactivated.

Upon activation of the compressor 12, coolant compressed by the compressor 12 passes through the coolant adjuster 6, bypasses the first heat exchanger 74 and the second heat exchanger 72 to the room cooling/heating switching valve 40, then exchanges heat with outdoor air in the outdoor heat exchanger 14, and is thereby condensed. The coolant condensed by the outdoor heat exchanger 14 is expanded by at least one of the outdoor expander 16 and the indoor expander 17 and evaporated by the indoor heat exchanger 18. The coolant evaporated by the indoor heat exchanger 18 passes through the room cooling/heating switching valve 40 and is then recovered to the compressor 12.

For example, the coolant discharged from the compressor 12 sequentially passes through the room cooling/heating switching valve 40, the outdoor heat exchanger 14, the outdoor expander 16, the indoor expander 17, the indoor heat exchanger 18, and the room cooling/heating switching valve 40 and is then recovered to the compressor 12.

In the heat pump-type hot water feeding apparatus, the outdoor heat exchanger 14 condenses coolant, and the indoor heat exchanger 18 evaporates coolant so that indoor air is cooled while exchanging heat with the indoor heat exchanger 18.

The heat pump-type hot water feeding apparatus is used to cool indoor air during the room cooling mode operation.

The heat pump-type hot water feeding apparatus according to the embodiments of the present invention may store heat through the heat storage tank 56 while performing the room cooling mode operation.

Figure 4:
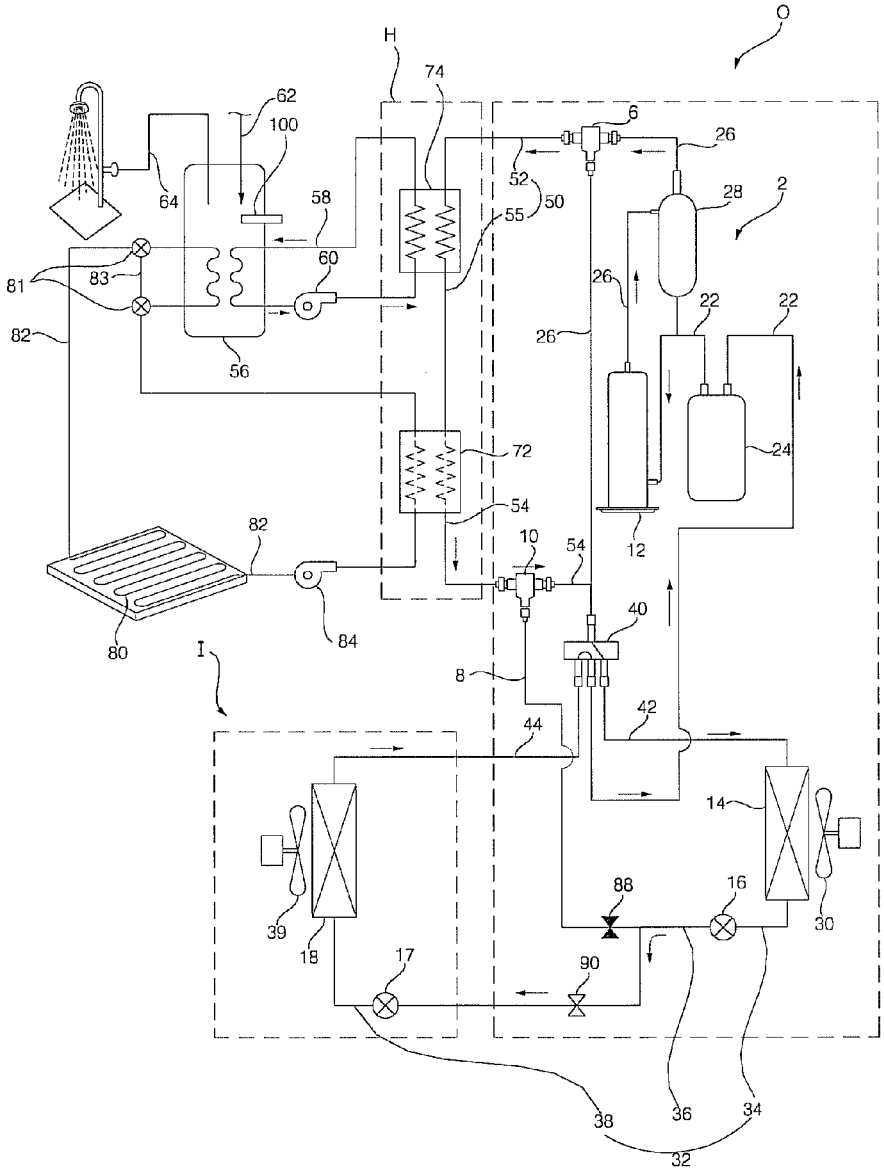
FIG. 4 illustrates a flow of coolant when the heat pump-type hot water feeding apparatus shown in FIG. 2 performs both a hot water feeding mode operation and a room cooling mode operation.

FIG. 4 illustrates a flow of coolant when the heat pump-type hot water feeding apparatus shown in FIG. 2 performs both a hot water feeding mode operation and a room cooling mode operation.

Referring to FIG. 4, the heat pump-type hot water feeding apparatus operates as follows when the room cooling mode operation is performed simultaneously with a heat storage mode operation that stores heat in the heat storage tank 56.

For example, the compressor 12 is activated, the coolant adjuster 6 adjusts coolant to pass through the first heat exchanger 74 and the second heat exchanger 72, the auxiliary coolant adjuster 10 adjusts coolant to flow from the hydro kit heat exchanger outlet path 54 to the discharge path 26 but not to the heat exchanger bypass path 8, the outdoor fan 30 and the indoor fan 39 are rotated, the room cooling/heating switching valve 40 is activated in a room cooling mode, the heat exchanger bypass valve 88 is closed, the liquid coolant valve 90 is opened, the hot water pump 60 is activated, and the floor heating pump 84 remains inactivated.

Upon activation of the compressor 12, the coolant activated by the compressor 12 sequentially passes through the coolant adjuster 6, the first heat exchanger 74, and the second heat exchanger 72 while exchanging heat with a heat transfer fluid flowing by the hot water pump 60, and is then condensed. Then, the coolant flows into the room cooling/heating switching valve 40 and exchanges heat with outdoor air in the outdoor heat exchanger 14, and is then recondensed.

A heat storage mode is operated in the heat storage tank 56 by using the heat transfer fluid that has experienced heat exchange in the first heat exchanger 74 and water introduced in the heat storage tank 56 through the water supplier 62. For example, upon heat storage mode operation that stores heat in the heat storage tank 56, heat exchanged only from the first heat exchanger 74 may be stored in the heat storage tank 56, or heat exchanged from both the first heat exchanger 74 and the second heat exchanger 72 may be stored in the heat storage tank 56. The heat stored in the heat storage tank 56 at the time of the maximum power consumption may be used for the hot water feeding operation or floor heating operation during a midnight time that low power rate applies or at a time escaping from the maximum power consumption time.

The coolant sequentially condensed by the first heat exchanger 74 and the second heat exchanger 72 passes through the auxiliary coolant adjuster 10 to the room cooling/heating switching valve 40, and is then condensed by the outdoor heat exchanger 14. The condensed coolant is expanded by at least one of the outdoor expander 16 and the indoor expander 17 and then evaporated by the indoor heat exchanger 18. The coolant evaporated by the indoor heat exchanger 18 passes through the room cooling/heating switching valve 40 and is then recovered to the compressor 12.

For example, the coolant discharged from the compressor 12 sequentially passes through the first heat exchanger 74, the room cooling/heating switching valve 40, the outdoor heat exchanger 14, the outdoor expander 16, the indoor expander 17, the indoor heat exchanger 18, and the room cooling/heating switching valve 40 to the compressor 12.

In the heat pump-type hot water feeding apparatus, the first heat exchanger 74 and the outdoor heat exchanger 14 condense coolant, and the indoor heat exchanger 18 evaporates the indoor heat exchanger 18 while indoor air exchanges heat with the indoor heat exchanger 18 and is then cooled. The first heat exchanger 74 heats water in the heat storage tank 56 to perform heat storage.

The heat stored in the heat storage tank 56 may be used for the hot water feeding operation pursuant to a user's selection so that the heat pump-type hot water feeding apparatus may perform both the room cooling operation and the heat storage operation. As such, heat storage may be performed while avoiding a time period that exhibits more burden in light of power rate so that the stored heat may be selectively used during a time period that shows less burden to customers.

Figure 5:
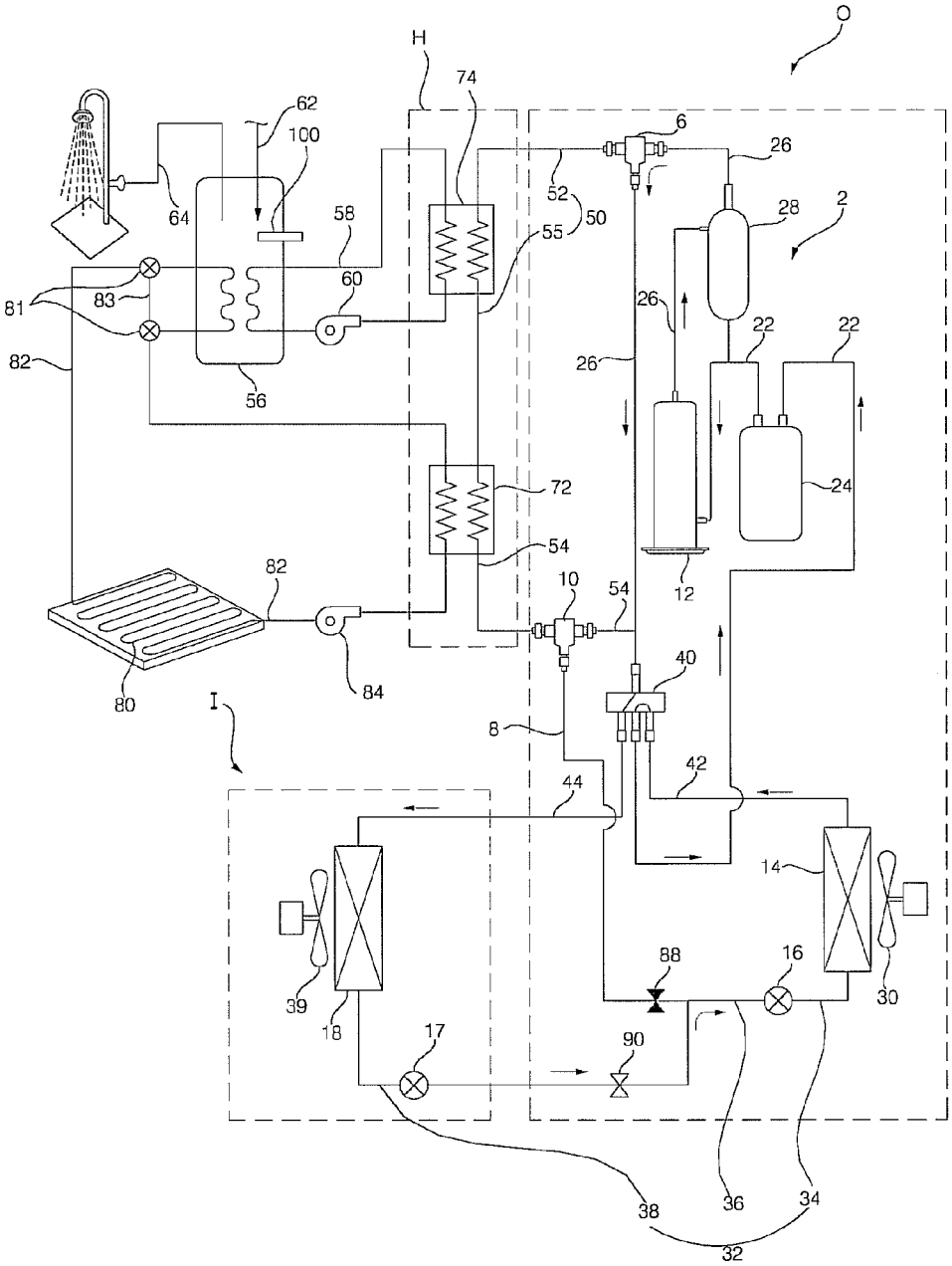
FIG. 5 illustrates a flow of coolant when the heat pump-type hot water feeding apparatus shown in FIG. 2 operates in a room heating mode.

FIG. 5 illustrates a flow of coolant when the heat pump-type hot water feeding apparatus shown in FIG. 2 operates in a room heating mode.

Under the room heating mode, the heat pump-type hot water feeding apparatus operates as follows. The compressor 12 is activated, the coolant adjuster 6 adjusts coolant to bypass the first heat exchanger 74, the second heat exchanger 72, and the auxiliary coolant adjuster 10 to the room cooling/heating switching valve 40, the outdoor fan 30 and the indoor fan 39 are rotated, the room cooling/heating switching valve 40 is activated in a room heating mode, the heat exchanger bypass valve 88 is closed, the liquid coolant valve 90 is opened, and the hot water pump 60 and the floor heating pump 84 remain inactivated.

Upon activation of the compressor 12, the coolant compressed by the compressor 12 passes through the coolant adjuster 6 and bypasses the first heat exchanger 74 and the second heat exchanger 72 to the room cooling/heating switching valve 40, and then exchanges heat with outdoor air in the indoor heat exchanger 18, and is thereby condensed. The coolant condensed by the indoor heat exchanger 18 is expanded by at least one of the outdoor expander 16 and the indoor expander 17 and evaporated by the outdoor heat exchanger 14. The coolant evaporated by the outdoor heat exchanger 14 passes through the room cooling/heating switching valve 40 and is then recovered to the compressor 12.

The coolant discharged from the compressor 12 sequentially passes through the room cooling/heating switching valve 40, the indoor heat exchanger 18, the outdoor expander 16, the indoor expander 17, the outdoor heat exchanger 14, and the room cooling/heating switching valve 40, and is then recovered to the compressor 12.

In the heat pump-type hot water feeding apparatus, the indoor heat exchanger 18 condenses coolant and the outdoor heat exchanger 14 evaporates coolant while indoor air exchanges heat with the indoor heat exchanger 18, and is thereby heated.

The heat pump-type hot water feeding apparatus performs a room heating mode operation to allow coolant to heat indoor air.

The heat pump-type hot water feeding apparatus according to the embodiments of the present invention may perform the heat storage mode operation capable of storing heat in the heat storage tank 56 simultaneously with the room heating mode operation.

Figure 6:
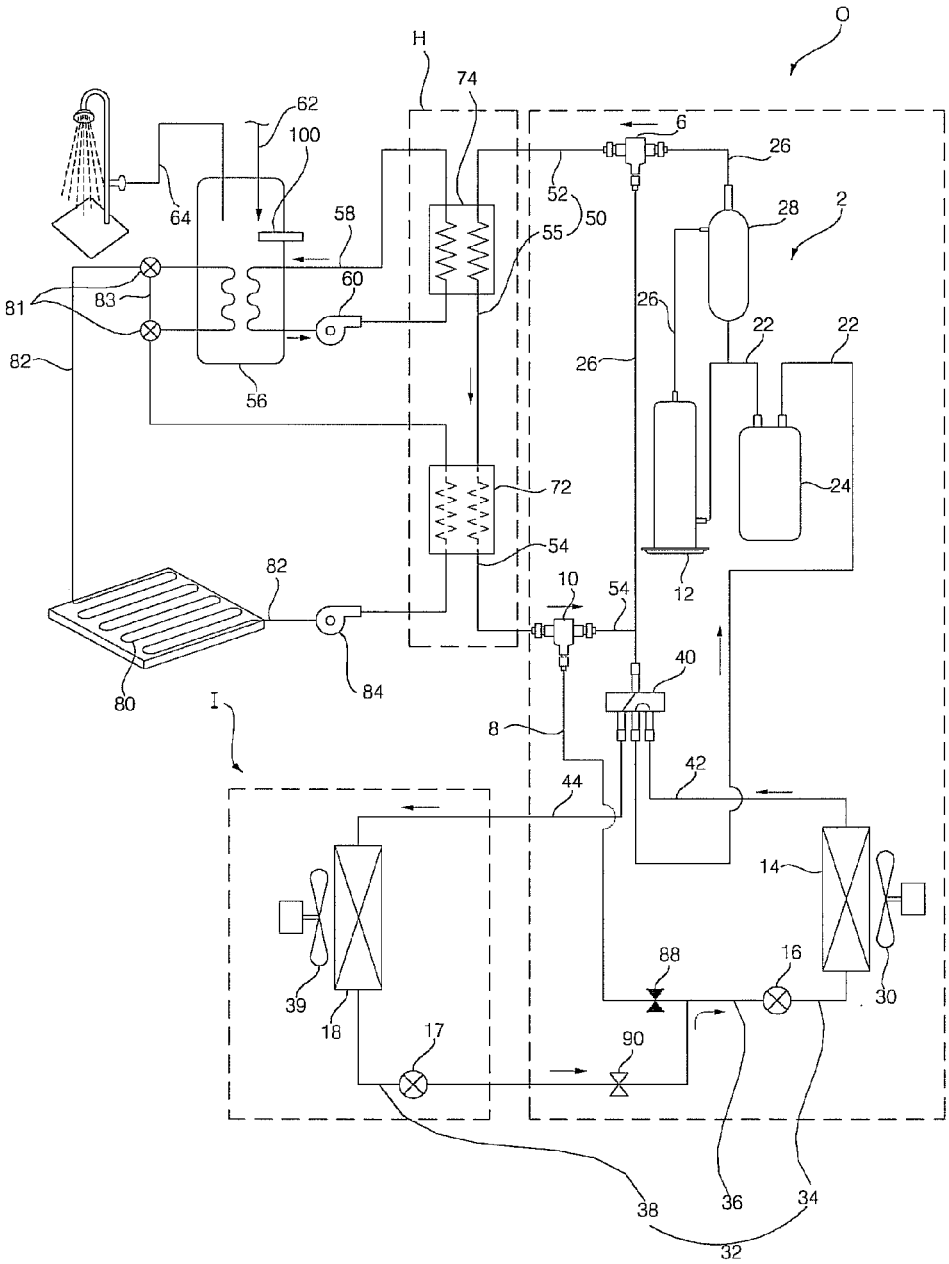
FIG. 6 illustrates a flow of coolant when the heat pump-type hot water feeding apparatus shown in FIG. 2 operates in a room heating mode and a heat storage mode.

FIG. 6 illustrates a flow of coolant when the heat pump-type hot water feeding apparatus shown in FIG. 2 operates in a room heating mode and a heat storage mode.

Upon simultaneous operation of the room heating mode and the heat storage mode, the heat pump-type hot water feeding apparatus operates as follows.

The compressor 12 is activated, the coolant adjuster 6 adjusts coolant to pass through the first heat exchanger 74 and the second heat exchanger 72, the auxiliary coolant adjuster 10 adjusts coolant from the hydro kit heat exchanger outlet path 54 to bypass the heat exchanger bypass path 8, the outdoor fan 30 and the indoor fan 39 are rotated, the room cooling/heating switching valve 40 is activated in a room heating mode, the heat exchanger bypass valve 88 is closed, the liquid coolant valve 90 is opened, the hot water pump 60 is activated, and the floor heating pump 84 remains inactivated.

On activation of the hot water pump 60, the heat transfer fluid flows from the heat storage tank 56 to the first heat exchanger 74 via the heat storage water pipe 58, and then passes through the first heat exchanger 74 to the heat storage tank 56.

Upon activation of the compressor 12, the coolant compressed by the compressor 12 passes through the coolant adjuster 6 and the hydro kit heat exchanger inlet path 52 to the first heat exchanger 74 and the second heat exchanger 72, passes through the first heat exchanger 74 and the second heat exchanger 72 while exchanging heat with the first heat transfer fluid and second heat transfer fluid, and is thereby condensed. The condensed coolant by the first heat exchanger 74 and the second heat exchanger 72 sequentially passes through the hydro kit heat exchanger outlet path 54 and the auxiliary coolant adjuster 10 to the room cooling/heating switching valve 40, and is then re-condensed while exchanging heat with indoor air in the indoor heat exchanger 18. The condensed coolant in the indoor heat exchanger 18 is expanded by at least one of the outdoor expander 16 and the indoor expander 17 and then evaporated by the outdoor heat exchanger 14. The evaporated coolant by the outdoor heat exchanger 14 passes through the room cooling/heating switching valve 40, and is then recovered to the compressor 12.

The coolant discharged from the compressor 12 sequentially passes through the first heat exchanger 74, the second heat exchanger 72, the room cooling/heating switching valve 40, the indoor heat exchanger 18, the outdoor expander 16, the indoor expander 17, the outdoor heat exchanger 14, and the room cooling/heating switching valve 40 and is then recovered to the compressor 12.

In the heat pump-type hot water feeding apparatus, the first heat exchanger 74, the second heat exchanger 72, and the indoor heat exchanger 18 condense coolant while performing the indoor room heating mode operation, the outdoor heat exchanger 14 evaporates the coolant, and the first heat exchanger 74 heats the heat storage water in the heat storage tank 56 to perform the heat storage mode operation.

For example, in the heat pump-type hot water feeding apparatus, coolant is used to heat the heat storage water in the heat storage tank 56 during simultaneous operation of the room heating mode and heat storage mode, and may be then used for heating indoor air.

Although not shown in the drawings, the heat pump-type hot water feeding apparatus may perform only a heat storage mode operation, for example, during an inter-season period that does not require room cooling/heating operations or indoor floor heating operation.

Referring to FIGS. 4 and 6, the heat pump-type hot water feeding apparatus operates as follows in a heat storage mode.

The compressor 12 is activated, the coolant adjuster 6 adjusts coolant to flow into the first heat exchanger 74 and the second heat exchanger 72, the auxiliary coolant adjuster 10 adjusts coolant to bypass the heat exchanger bypass path 8, the room cooling/heating switching valve 40 is activated in a room heating mode, the heat exchanger bypass valve 88 is closed, the liquid coolant valve 90 is opened, the outdoor fan 30 is rotated, the indoor fan 39 is not rotated, the hot water pump 60 is activated, and the floor heating pump 84 remains inactivated.

The coolant discharged from the compressor 12 sequentially passes through the first heat exchanger 74, the second heat exchanger 72, the room cooling/heating switching valve 40, the indoor heat exchanger 18, the outdoor expander 16, the indoor expander 17, the outdoor heat exchanger 14, and the room cooling/heating switching valve 40 and is then recovered to the compressor 12. The coolant may perform only heat exchange through the first and second heat transfer fluids with the heat storage water that flows through the coolant adjuster 6 in the heat storage mode operation rather than performs a room heating mode operation.

However, under this situation, the temperature of the coolant may be insufficient for hot water feeding. Accordingly, the sub heater 100 may be further provided in the heat storage tank 56 for providing electrical heating. The sub heater 100 may increase power consumption, however, may be temporarily used, for example, for an inter-season period that does not require room cooling/heating, thus relieving customers of burden.

Figure 7:
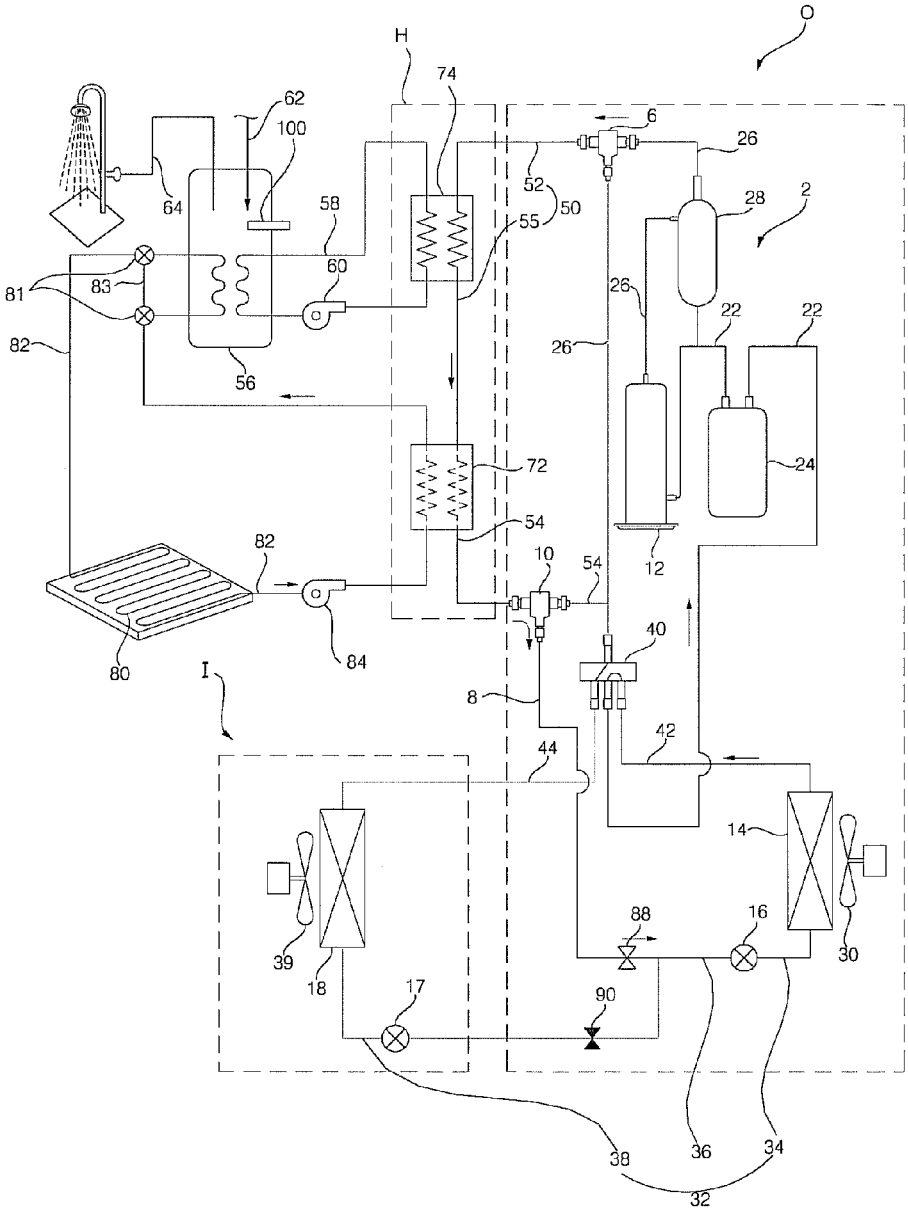
FIG. 7 illustrates a flow of coolant when the heat pump-type hot water feeding apparatus shown in FIG. 2 operates in a floor heating mode.

FIG. 7 illustrates a flow of coolant when the heat pump-type hot water feeding apparatus shown in FIG. 2 operates in a floor heating mode.

Under the floor heating mode, the heat pump-type hot water feeding apparatus operates as follows.

The compressor 12 is activated, the coolant adjuster 6 adjusts coolant to flow to the first heat exchanger 74 and the second heat exchanger 72, the auxiliary coolant adjuster 10 adjusts coolant from the hydro kit heat exchanger outlet path 54 to pass through the heat exchanger bypass path 8, the outdoor fan 30 is rotated, the indoor fan 39 is not rotated, the room cooling/heating switching valve 40 is activated in a room heating mode, the heat exchanger bypass valve 88 is opened, the liquid coolant valve 90 is closed, the floor heating pump 84 is activated, and the hot water pump 60 remains inactivated.

Upon activation of the floor heating pump 84, the second heat transfer fluid which is floor heating water for the floor heating pipe 80 sequentially passes through the room heating water pipe 82 and the second heat exchanger 72 to the floor heating pipe 80.

When the floor heating operation is not required, the operation of the floor heating pump 84 may be stopped or may be temporarily performed to store condensation heat of the second heat transfer fluid transferred from the coolant of the second heat exchanger 72 in the heat storage tank 56.

As shown in FIG. 7, when the floor heating pump 84 is activated, water in the room heating water pipe 82 exchanges heat with coolant of the second heat exchanger 72 and then flows into the floor heating pipe 80 via the bypass path 83. This flow may be achieved in a mere floor heating mode operation but not in a heat storage mode operation.

However, when the floor heating pump 84 is activated and the second heat transfer fluid in the room heating water pipe 82 exchanges heat with the coolant of the second heat exchanger 72 and then bypasses the bypass path 83 to store heat in the heat storage tank 56, the heat storage mode operation is achieved rather than the floor heating mode operation.

As described earlier, the heat stored in the heat storage tank 56 enables various operations, such as the room heating mode operation or hot water feeding mode operation in various time periods or conditions depending on a user's selection.

Upon activation of the compressor 12, the coolant compressed by the compressor 12 passes through the coolant adjuster 6 and the hydro kit heat exchanger inlet path 52 and then flows into the first heat exchanger 74. Then, the coolant passes through the first heat exchanger 74 without heat exchange and is then introduced into the second heat exchanger 72. The coolant introduced in the second heat exchanger 72 passes through the second heat exchanger 72 while exchanging heat with the second heat transfer fluid and is then condensed. The coolant condensed by the second heat exchanger 72 passes through the auxiliary coolant adjuster 10 and flows into the heat exchanger bypass path 8. The coolant flowing into the heat exchanger bypass path 8 passes through the heat exchanger bypass valve 88 and is expanded by the outdoor expander 16, then evaporated while performing heat exchange with outdoor air in the outdoor heat exchanger 14. The evaporated coolant in the outdoor heat exchanger 14 passes through the room cooling/heating switching valve 40 and is then recovered to the compressor 12.

For example, the coolant discharged from the compressor 12 sequentially passes through the first heat exchanger 74, the second heat exchanger 72, the heat exchanger bypass path 8, the outdoor expander 16, the outdoor heat exchanger 14, and the room cooling/heating switching valve 40 and is then recovered to the compressor 12.

In the heat pump-type hot water feeding apparatus, the second heat exchanger 72 condenses coolant, the outdoor heat exchanger 14 evaporates the coolant, and the second heat exchanger 72 heats water in the floor heating pipe 80.

In the heat pump-type hot water feeding apparatus, during the floor heating operation, coolant is used to heat the second heat transfer fluid that is floor heating water for the floor heating pipe 80, so that the heat pump-type hot water feeding apparatus may raise the temperature of the second heat transfer fluid of the floor heating pipe 80 more quickly than when the coolant passes through the indoor heat exchanger 18 or when the hot water pump 60 is activated.

Figure 8:
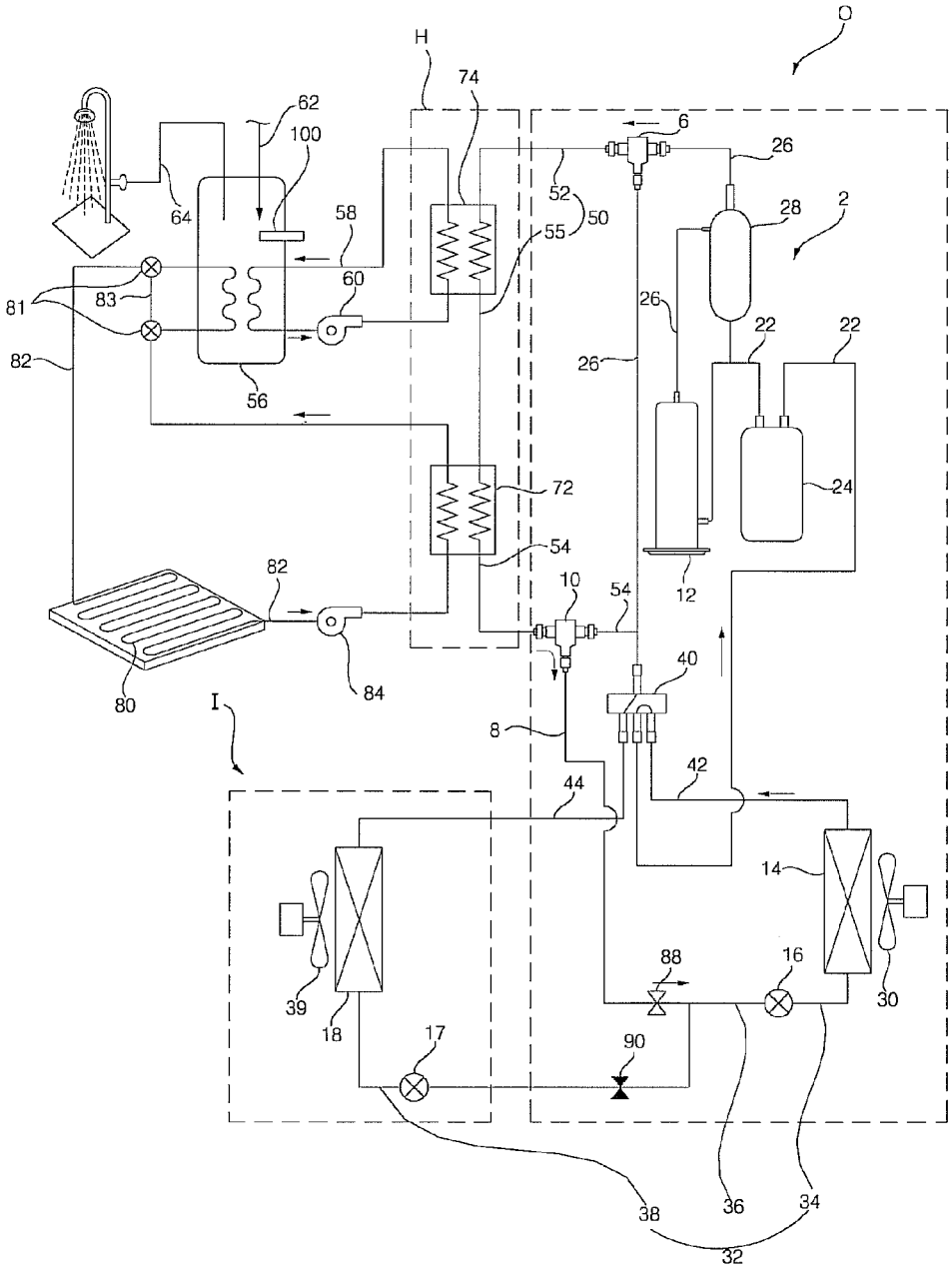
FIG. 8 illustrates a flow of coolant when the heat pump-type hot water feeding apparatus shown in FIG. 2 operates in a floor heating mode and hot water feeding mode.

FIG. 8 illustrates a flow of coolant when the heat pump-type hot water feeding apparatus shown in FIG. 2 operates in a floor heating mode and hot water feeding mode.

Upon simultaneous operation of the floor heating mode and hot water feeding mode, the heat pump-type hot water feeding apparatus operates as follows. The compressor 12 is activated, the coolant adjuster 6 adjusts coolant to flow to the first heat exchanger 74 and the second heat exchanger 72, the auxiliary coolant adjuster 10 adjusts coolant from the hydro kit heat exchanger outlet path 54 to pass through the heat exchanger bypass path 8, the outdoor fan 30 is rotated, the indoor fan 39 is not rotated, the room cooling/heating switching valve 40 is activated in a room heating mode, the heat exchanger bypass valve 88 is opened, the liquid coolant valve 90 is closed, the hot water pump 60 is activated, and the floor heating pump 84 is activated.

Upon activation of the hot water pump 60, the first heat transfer fluid flows through the heat storage water pipe 58 to the first heat exchanger 74, and then passes through the first heat exchanger 74 to the heat storage tank 56.

Upon activation of the floor heating pump 84, the second heat transfer fluid of the floor heating pipe 80 flows through the room heating water pipe 82 to the second heat exchanger 72, and then passes through the second heat exchanger 72 to the floor heating pipe 80.

Upon activation of the compressor 12, the coolant compressed by the compressor 12 passes through the coolant adjuster 6 and the hydro kit heat exchanger inlet path 52 and flows into the first heat exchanger 74 and the second heat exchanger 72, and then passes through the first heat exchanger 74 and the second heat exchanger 72 while the coolant overheated in the compressor 12 sequentially exchanges heat with the first and second heat transfer fluids. The condensed coolant in the first heat exchanger 74 and the second heat exchanger 72 passes through the auxiliary coolant adjuster 10 to the heat exchanger bypass path 8. Then, the coolant passes through the heat exchanger bypass valve 88 and is then expanded by the outdoor expander 16, then exchanges heat with outdoor air in the outdoor heat exchanger 14 to be evaporated. The evaporated coolant in the outdoor heat exchanger 14 passes through the room cooling/heating switching valve 40 and is then recovered to the compressor 12.

For example, the coolant discharged from the compressor 12 sequentially passes through the first heat exchanger 74, the second heat exchanger 72, the heat exchanger bypass path 8, the outdoor expander 16, the outdoor heat exchanger 14, and the room cooling/heating switching valve 40 and is then recovered to the compressor 12.

In the heat pump-type hot water feeding apparatus, the first heat exchanger 74 and the second heat exchanger 72 sequentially condense coolant, the outdoor heat exchanger 14 evaporates the coolant, the first heat exchanger 74 heats heat storage water in the heat storage tank 56 through the first heat transfer fluid, and the second heat exchanger 72 directly heats the second heat transfer fluid in the floor heating pipe 80.

In the heat pump-type hot water feeding apparatus, during both the floor heating mode operation and the hot water feeding mode operation, the coolant is used to the second heat transfer fluid of the floor heating pipe 80 and the heat storage water of the heat storage tank 56. The heat pump-type hot water feeding apparatus may raise the temperature of the second heat transfer fluid that is floor heating water for the floor heating pipe 80 and the temperature of the heat storage tank 56 more swiftly than when the coolant passes through the indoor heat exchanger 18.

Figure 9:
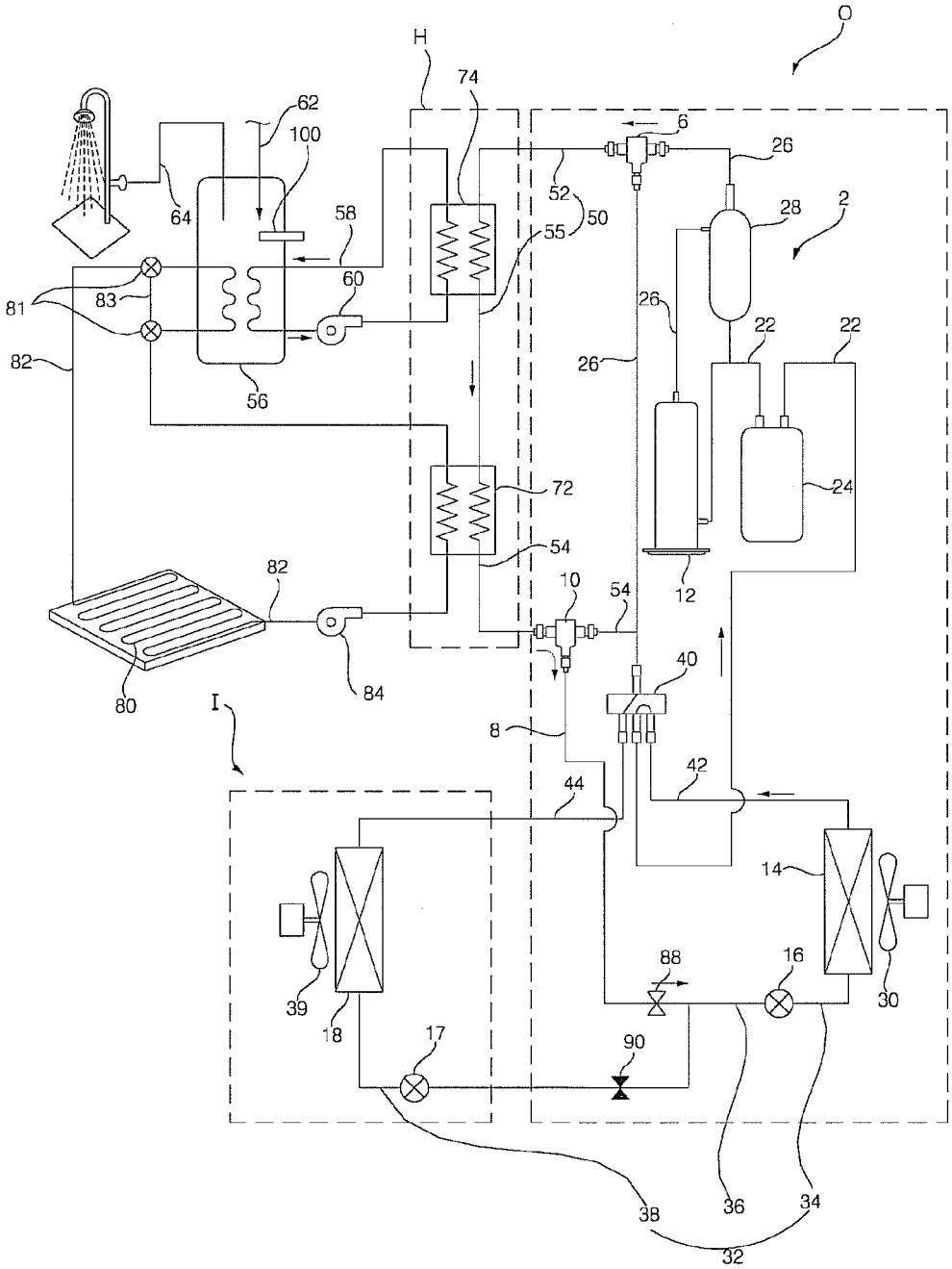
FIG. 9 illustrates a flow of coolant when the heat pump-type hot water feeding apparatus shown in FIG. 2 operates in a hot water feeding mode.

FIG. 9 illustrates a flow of coolant when the heat pump-type hot water feeding apparatus shown in FIG. 2 operates in a hot water feeding mode.

Under the hot water feeding mode, the heat pump-type hot water feeding apparatus operates as follows. The compressor 12 is activated, the coolant adjuster 6 adjusts coolant to flow to the first heat exchanger 74 and the second heat exchanger 72, the auxiliary coolant adjuster 10 adjusts coolant from the hydro kit heat exchanger outlet path 54 to pass through the heat exchanger bypass path 8, the outdoor fan 30 is rotated, the indoor fan 39 is not rotated, the room cooling/heating switching valve 40 is activated in a room heating mode, the heat exchanger bypass valve 88 is opened, the liquid coolant valve 90 is closed, the hot water pump 60 is activated, and the floor heating pump 84 remains inactivated.

Upon activation of the hot water pump 60, the first heat transfer fluid flows through the heat storage water pipe 58 to the first heat exchanger 74, and then passes through the first heat exchanger 74 to the heat storage tank 56.

Upon activation of the compressor 12, the coolant compressed by the compressor 12 passes through the coolant adjuster 6 and the hydro kit heat exchanger inlet path 52 to the first heat exchanger 74, and the passes through the first heat exchanger 74 while the coolant overheated in the compressor 12 exchanges heat with the first heat transfer fluid to be condensed. The condensed fluid is introduced through the second heat exchanger 72 to the auxiliary coolant adjuster 10. The introduced coolant flows to the heat exchanger bypass path 8 and passes through the heat exchanger bypass valve 88 and is then expanded by the outdoor expander 16. The expanded coolant is evaporated by the outdoor heat exchanger 14 while exchanging heat with outdoor air and passes through the room cooling/heating switching valve 40, and is then recovered to the compressor 12.

For example, the coolant discharged from the compressor 12 sequentially passes through the first heat exchanger 74, the heat exchanger bypass path 8, the outdoor expander 16, the outdoor heat exchanger 14, and the room cooling/heating switching valve 40 and is then recovered to the compressor 12.

In the heat pump-type hot water feeding apparatus, the first heat exchanger 74 condenses coolant, the outdoor heat exchanger 14 evaporates the coolant, and the first heat exchanger 74 heats the heat storage water of the heat storage tank 56 through the first heat transfer fluid.

In the heat pump-type hot water feeding apparatus, during the hot water feeding mode operation, coolant is used to heat the heat storage water in the heat storage tank 56 through the first heat transfer fluid. The heat pump-type hot water feeding apparatus may raise the temperature of the heat storage water in the heat storage tank 56 more quickly than when the coolant passes through the indoor heat exchanger 18.

Figure 10:
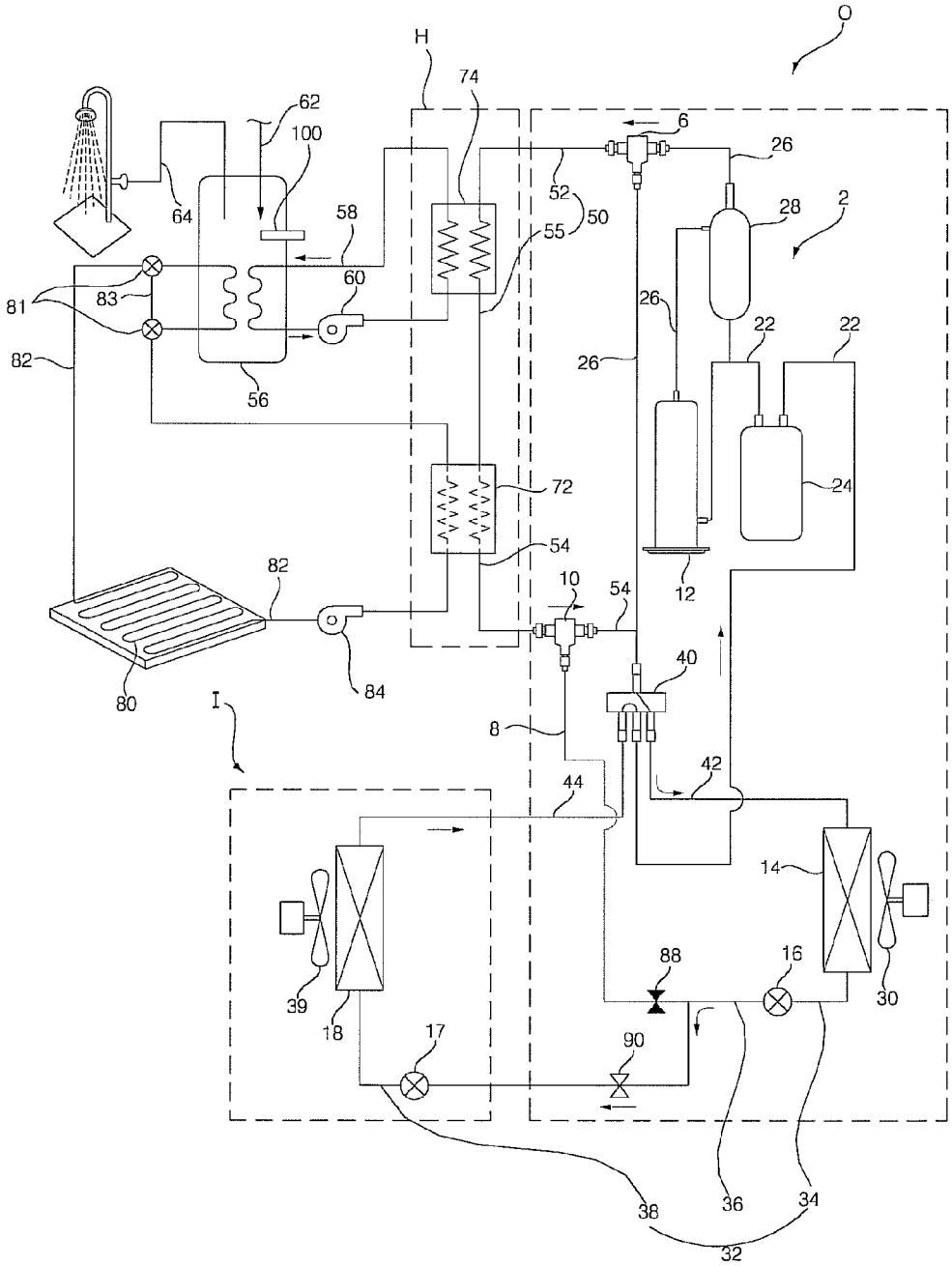
FIG. 10 illustrates a flow of coolant when the heat pump-type hot water feeding apparatus shown in FIG. 9 switches from the hot water feeding mode operation to a defrost mode operation.

FIG. 10 illustrates a flow of coolant when the heat pump-type hot water feeding apparatus shown in FIG. 9 switches from the hot water feeding mode operation to a defrost mode operation.

Since in the heat pump-type hot water feeding apparatus, the outdoor heat exchanger 14 operates as an evaporator during the hot water feeding mode operation, frost may be created in the outdoor heat exchanger 14. The heat pump-type hot water feeding apparatus switches to defrost the outdoor heat exchanger 14 while continuing to perform the hot water feeding operation when a predetermined defrost condition is met.

The heat pump-type hot water feeding apparatus adjusts the auxiliary coolant adjuster 10 so that coolant passing through the first heat exchanger 74 bypasses the heat exchanger bypass path 8, and switches the cooling cycle circuit 2 from the room heating operation to the room cooling operation.

The defrost condition includes a condition where an accumulated time of the hot water feeding mode operation is more than a predetermined time and a condition where a temperature of the outdoor heat exchanger 14 is lower than a predetermined temperature.

In the heat pump-type hot water feeding apparatus, the auxiliary coolant adjuster 10 is adjusted to let coolant flow to the room cooling/heating switching valve 40 while performing the hot water feeding mode operation. Further, the room cooling/heating switching valve 40 is activated in the room cooling mode, the liquid coolant valve 90 is opened, and the heat exchanger bypass valve 88 is closed.

The coolant is compressed by the compressor 12 and then condensed while passing through the first heat exchanger 74. Then, the condensed coolant passes through the auxiliary coolant adjuster 10 while bypassing the heat exchanger bypass path 8, and is then introduced into the room cooling/heating switching valve 40. The coolant passing through the room cooling/heating switching valve 40 flows into the outdoor heat exchanger 14 while defrosting the outdoor heat exchanger 14 and is condensed again. Then, the coolant passes through at least one of the outdoor expander 16 and the indoor expander 17 to be expanded, and then passing through the indoor heat exchanger 18 to be evaporated. The coolant evaporated in the indoor heat exchanger 18 passes through the room cooling/heating switching valve 40 and is then recovered to the compressor 12.

For example, the coolant discharged from the compressor 12 sequentially passes through the first heat exchanger 74, the room cooling/heating switching valve 40, the outdoor heat exchanger 14, the outdoor expander 16, the indoor expander 17, the indoor heat exchanger 18, and the room cooling/heating switching valve 40 and is then recovered to the compressor 12.

In the heat pump-type hot water feeding apparatus, the first heat exchanger 74 condenses coolant and the outdoor heat exchanger 14 re-condenses the coolant to perform defrost, and the first heat exchanger 74 heats water in the heat storage tank 56.

Since the coolant defrosts the outdoor heat exchanger 14 while continuing to heat the heat storage water in the heat storage tank 56 during the hot water feeding operation, the heat pump-type hot water feeding apparatus may raise the temperature of the heat storage water in the heat storage tank 56 more quickly while enhancing efficiency of hot water feeding.

Figure 11:
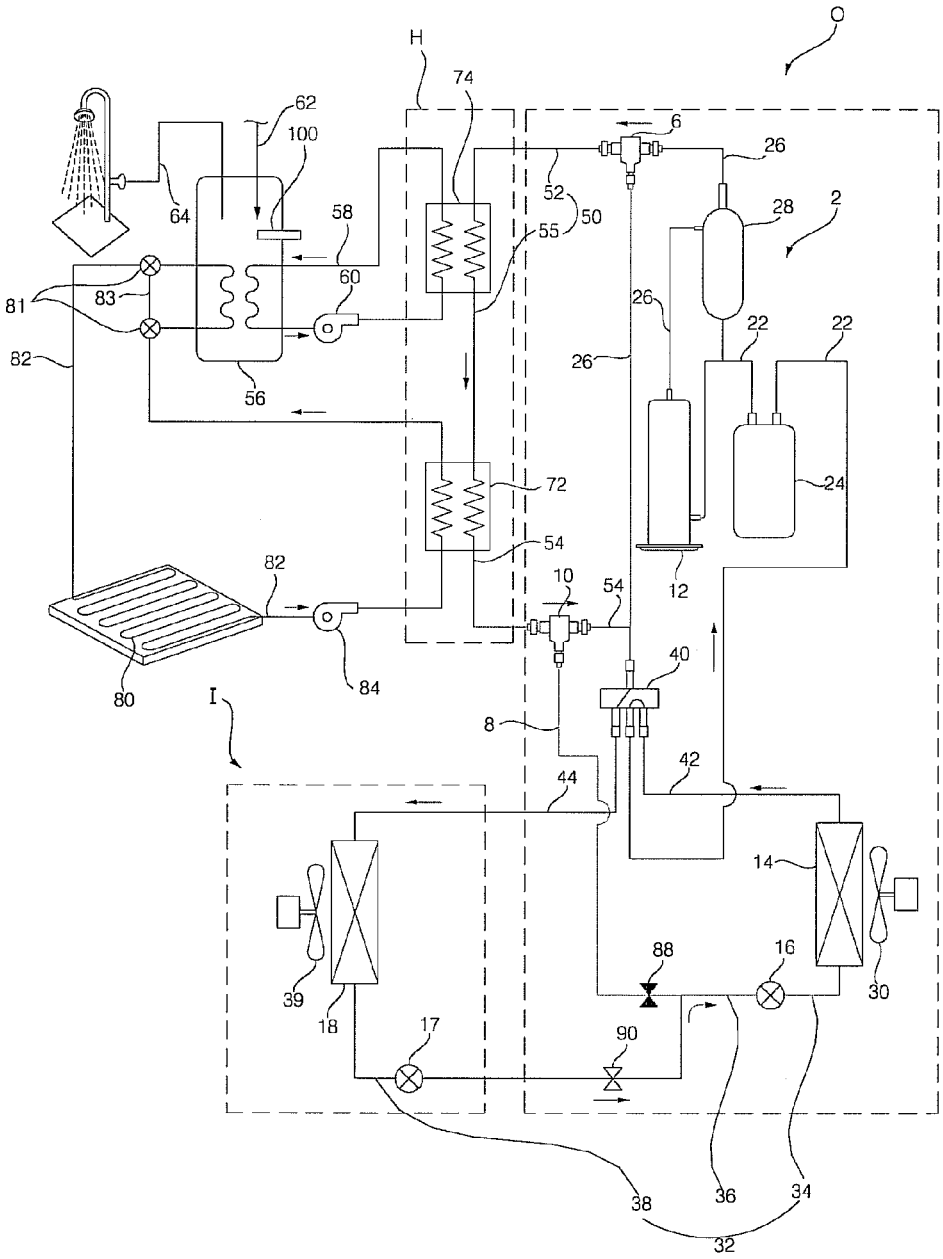
FIG. 11 illustrates a flow of coolant when the heat pump-type hot water feeding apparatus shown in FIG. 2 operates in a room heating mode, a floor heating mode, and a hot water feeding mode.

FIG. 11 illustrates a flow of coolant when the heat pump-type hot water feeding apparatus shown in FIG. 2 operates in a room heating mode, a floor heating mode, and a hot water feeding mode.

Upon simultaneous operation of the floor heating mode, the hot water feeding mode, and the room heating mode, the heat pump-type hot water feeding apparatus operates as follows.

The compressor 12 is activated, the coolant adjuster 6 adjusts coolant to flow to the first heat exchanger 74 and the second heat exchanger 72, the auxiliary coolant adjuster 10 adjusts coolant from the hydro kit heat exchanger outlet path 54 to bypass the heat exchanger bypass path 8, the outdoor fan 30 is rotated, the indoor fan 39 is rotated, the room cooling/heating switching valve 40 is activated in a room heating mode, the heat exchanger bypass valve 88 is closed, the liquid coolant valve 90 is opened, the hot water pump 60 is activated, and the floor heating pump 84 is activated.

Upon activation of the hot water pump 60, the first heat transfer fluid flows through the heat storage water pipe 58 to the first heat exchanger 74, and then passes through the first heat exchanger 74 to the heat storage tank 56.

Upon activation of the floor heating pump 84, the second heat transfer fluid of the floor heating pipe 80 flows through the room heating water pipe 82 to the second heat exchanger 72, and then passes through the second heat exchanger 72 to the floor heating pipe 80.

Upon activation of the compressor 12, the coolant compressed by the compressor 12 passes through the coolant adjuster 6 and the hydro kit heat exchanger inlet path 52 to the first heat exchanger 74, and passes through the first heat exchanger 74 while the coolant overheated in the compressor 12 exchanges heat with the first heat transfer fluid and is then condensed. The condensed coolant is introduced into the second heat exchanger 72 and then passes through the second heat exchanger 72 while exchanging heat with the second heat transfer fluid to be condensed again. The condensed coolant in the second heat exchanger 72 is discharged through a room heating inlet path 76 to the hydro kit heat exchanger outlet path 54, and the passes through the auxiliary coolant adjuster 10 and bypasses the heat exchanger bypass path 8 to the room cooling/heating switching valve 40. The coolant flowing into the 40 flows into the indoor heat exchanger 18 to be condensed again, and then expanded by at least one of the indoor expander 17 and the outdoor expander 16, then exchanges heat with outdoor air in the outdoor heat exchanger 14 to be evaporated. The evaporated coolant passes through the room cooling/heating switching valve 40 and is then recovered to the compressor 12.

For example, the coolant discharged from the compressor 12 sequentially passes through the first heat exchanger 74, the second heat exchanger 72, the room cooling/heating switching valve 40, the indoor heat exchanger 18, the indoor expander 17, the outdoor expander 16, the outdoor heat exchanger 14, and the room cooling/heating switching valve 40 and is then recovered to the compressor 12.

In the heat pump-type hot water feeding apparatus, the coolant is condensed three times while passing through the first heat exchanger 74, the second heat exchanger 72, and the indoor heat exchanger 18. The outdoor heat exchanger 14 evaporates the coolant, the first heat exchanger 74 heats the heat storage water in the heat storage tank 56 through the first heat transfer fluid, and the second heat exchanger 72 heats the second heat transfer fluid in the floor heating pipe 80.

In the heat pump-type hot water feeding apparatus, upon simultaneous operation of the floor heating mode, the hot water feeding mode, and the room heating mode, the coolant is used to heat all of the heat storage water in the heat storage tank 56, floor heating water in the floor heating pipe 80, and indoor air. Accordingly, the heat pump-type hot water feeding apparatus may effectively perform hot water feeding, floor heating, and room heating.

As described above, the heat pump-type hot water feeding apparatus according to the embodiments of the present invention may function as a heat exchanger for heat storage only, which may store heat exchanged while the first heat exchanger 74 operates in a mode including a heat storage mode in the heat storage tank 56.

The second heat exchanger 72 may function as a floor heating/heat storage heat exchanger that may perform heat exchange between coolant and the floor heating water for floor heating during a floor heating mode operation and stores in the heat storage tank 56 heat exchanged while performing another mode operation including the heat exchange mode operation.

In sum, during the heat storage mode operation, the heat pump-type hot water feeding apparatus according to the embodiments of the present invention may store in the heat storage water for hot water feeding heat exchanged with the first heat exchanger 74 through the first heat storage water path that passes through the heat storage tank 56, may store in the heat storage water for hot water feeding heat exchanged with the second heat exchanger 72 through the second heat storage water path that passes through the heat storage tank 56, or may simultaneously store in the heat storage water for hot water feeding heat sequentially exchanged with the first heat exchanger 74 and the second heat exchanger 72 through the first and second heat storage water paths that pass through the heat storage tank 56.

The invention has been explained above with reference to exemplary embodiments. It will be evident to those skilled in the art that various modifications may be made thereto without departing from the broader spirit and scope of the invention. Further, although the invention has been described in the context its implementation in particular environments and for particular applications, those skilled in the art will recognize that the present invention's usefulness is not limited thereto and that the invention can be beneficially utilized in any number of environments and implementations. The foregoing description and drawings are, accordingly, to be regarded in an illustrative rather than a restrictive sense.

What is claimed is:

1. A heat pump-type hot water feeding apparatus comprising: a cooling cycle circuit configured so that coolant flows through a compressor, an indoor heat exchanger, an expander, and an outdoor heat exchanger; a heat storage tank that stores heat exchanged with coolant branched from the cooling cycle circuit; and a hydro kit heat exchanging unit that includes a first heat exchanger that performs heat exchange between a first heat transfer fluid and coolant compressed in a supersaturated region by the compressor and primarily condenses the coolant and a second heat exchanger that performs heat exchange between the primarily condensed coolant and a second heat transfer fluid and secondarily condenses the coolant, wherein the hydro kit heat exchanging unit is connected to the cooling cycle circuit, wherein during a heat storage mode operation that stores heat in the heat storage tank, heat of the first heat transfer fluid, the first heat transfer fluid is heat exchanged in the first heat exchanger, is stored in the heat storage tank or heat of the first heat transfer fluid, the first heat transfer fluid is heat exchanged in the first heat exchanger and heat of the second heat transfer fluid, the second heat transfer fluid is heat exchanged in the second heat exchanger, are simultaneously stored in the heat storage tank.

2. The heat pump-type hot water feeding apparatus of claim 1, wherein the heat of the second heat transfer fluid is not only stored in the heat storage tank but also used for floor heating water of a floor heating unit according to a user's selection.

3. The heat pump-type hot water feeding apparatus of claim 2, wherein the first and second heat transfer fluids respectively flow through a first heat storage path and a second heat storage path that pass through the heat storage tank to store heat in heat storage water contained in the heat storage tank.

4. The heat pump-type hot water feeding apparatus of claim 3, wherein during the heat storage mode operation, the heat of the first heat transfer fluid alone is stored in the heat storage water, the heat of the second heat transfer fluid alone is stored in the heat storage water, or the heat of the first and second heat transfer fluids are simultaneously stored in the heat storage water.

5. The heat pump-type hot water feeding apparatus of claim 1, wherein the first heat exchanger is a heat exchanger only for heat storage, the first heat exchanger stores in the heat storage tank heat exchanged during a mode operation including the heat storage mode operation.

6. The heat pump-type hot water feeding apparatus of claim 2, wherein the second heat exchanger performs heat exchanger between the floor heating water and the coolant for floor heating during a floor heating mode operation and stores in the heat storage tank heat of the floor heating water, the heat of floor heating water is exchanged during a mode operation including the heat storage mode operation.

7. The heat pump-type hot water feeding apparatus of claim 5, wherein the mode operation includes a room cooling mode operation for room cooling, a room heating mode operation for room heating, and a hot water feeding mode operation for providing the heat storage water contained in the heat storage tank, wherein the heat storage mode operation alone is performed, or the heat storage mode operation and the mode operation are simultaneously performed.

8. The heat pump-type hot water feeding apparatus of claim 7, further comprising: a coolant adjuster that is provided in the cooling cycle circuit and enables the coolant to selectively flow to the hydro kit heat exchanging unit.

9. The heat pump-type hot water feeding apparatus of claim 8, wherein the coolant adjuster enables the coolant to selectively flow to at least one of the cooling cycle circuit or the hydro kit heat exchanging unit.

10. The heat pump-type hot water feeding apparatus of claim 8, wherein the coolant adjuster adjusts the coolant to flow to the hydro kit heat exchanger when at least one of the hot water feeding mode operation, the floor heating mode operation, and the heat storage mode operation is performed.

11. The heat pump-type hot water feeding apparatus of claim 8, wherein the coolant adjuster adjusts the coolant to bypass the hydro kit heat exchanging unit when at least one of the room heating mode operation and the room cooling mode operation is only performed.

12. The heat pump-type hot water feeding apparatus of claim 9, further comprising: a heat exchanger bypass path that guides coolant passing through the first and second heat exchangers to between the outdoor heat exchanger and the indoor heat exchanger so that the coolant bypasses one of the outdoor heat exchanger and the indoor heat exchanger.

13. The heat pump-type hot water feeding apparatus of claim 12, wherein coolant selectively flows through the heat exchanger bypass path by an auxiliary coolant adjuster that is provided between the heat exchanger bypass path and the hydro kit heat exchanging unit.

14. The heat pump-type hot water feeding apparatus of claim 13, wherein the auxiliary coolant adjuster adjusts the coolant to flow through the heat exchanger bypass path when only any one of the heat storage mode operation, the hot water feeding mode operation, and the floor heating mode operation is performed.

15. The heat pump-type hot water feeding apparatus of claim 13, wherein the auxiliary coolant adjuster adjusts the coolant to bypass the heat exchanger bypass path when any one of the heat storage mode operation, the hot water feeding mode operation, and the floor heating mode operation is performed together with one of the room cooling mode operation and the room heating mode operation.

16. The heat pump-type hot water feeding apparatus of claim 8, further comprising: a sub heater that electrically heats the heat storage water in the heat storage tank, wherein the sub heater is activated only in a heat storage mode that stores heat in the heat storage water of the heat storage tank.

* * * * *